US009290027B2

(12) United States Patent
Nagata et al.

(10) Patent No.: US 9,290,027 B2
(45) Date of Patent: Mar. 22, 2016

(54) LINE PRINTER AND PRINTHEAD MOVING METHOD OF A LINE PRINTER

(71) Applicant: Seiko Epson Corporation, Tokyo (JP)

(72) Inventors: Norio Nagata, Matsumoto (JP); Hironori Maekawa, Suwa (JP); Takashi Aoki, Shiojiri (JP); Taku Hirashima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/528,294

(22) Filed: Oct. 30, 2014

(65) Prior Publication Data

US 2015/0116424 A1 Apr. 30, 2015

(30) Foreign Application Priority Data

Oct. 30, 2013 (JP) ..... 2013-225052
Nov. 12, 2013 (JP) ..... 2013-233737

(51) Int. Cl.

| | |
|---|---|
| ***B41J 25/34*** | (2006.01) |
| ***B41J 2/165*** | (2006.01) |
| ***B41J 25/304*** | (2006.01) |
| ***B41J 25/308*** | (2006.01) |

(52) U.S. Cl.

CPC ..... *B41J 25/34* (2013.01); *B41J 2/16588* (2013.01); *B41J 25/304* (2013.01); *B41J 25/3084* (2013.01)

(58) Field of Classification Search

CPC .... C12Q 1/6837; B41J 2/16585; B41J 25/308
See application file for complete search history.

(56) References Cited

U.S. PATENT DOCUMENTS

| | | | | |
|---|---|---|---|---|
| 3,859,003 | A * | 1/1975 | Schulz et al. | 408/234 |
| 4,300,142 | A * | 11/1981 | Kos | 347/188 |
| 4,814,795 | A * | 3/1989 | Kuester et al. | 347/8 |
| 7,008,482 | B2 * | 3/2006 | Goto | 118/323 |
| 8,147,031 | B2 * | 4/2012 | Shinoda | 347/32 |
| 2005/0062798 | A1 * | 3/2005 | Kerr | 347/37 |
| 2005/0169808 | A1 * | 8/2005 | Pinkel et al. | 422/100 |
| 2011/0012957 | A1 * | 1/2011 | Kersey et al. | 347/33 |
| 2013/0127949 | A1 | 5/2013 | Ishida | |

FOREIGN PATENT DOCUMENTS

| | | |
|---|---|---|
| JP | 2011-025479 A | 2/2011 |
| JP | 2013-056464 A | 3/2013 |

* cited by examiner

*Primary Examiner* — Stephen Meier
*Assistant Examiner* — John P Zimmermann
(74) *Attorney, Agent, or Firm* — Nutter McClennen & Fish LLP; John J. Penny, Jr.; Joshua I. Rudawitz

(57) ABSTRACT

The carriage of a line printer has a head unit that supports a printhead, and a carriage frame that supports the head unit movably up and down. When moving the carriage from a standby position to an opposing position, the carriage is moved while the head unit is held at a up position where the gap to the platen unit is a first distance. The head unit is then lowered at the standby position from the up position to a down position where the platen gap is a second distance that is shorter than the first distance.

20 Claims, 15 Drawing Sheets

LINE PRINTER AND PRINTHEAD MOVING METHOD OF A LINE PRINTER

Priority is claimed under 35 U.S.C. §119 to Japanese Application Nos. 2013-225052 and 2013-233737 filed on Oct. 30, 2013 and Nov. 12, 2013, respectively, both of which are incorporated in their entireties.

BACKGROUND

1. Technical Field

The present disclosure relates to a line printer that moves the printhead between a position opposite the platen and a position removed to the side from the position opposite the platen, and to a method of moving a printhead in a line printer.

2. Related Art

A line printer that prints on recording paper conveyed at a constant speed over a platen is described in JP-A-2011-025479. The line printer in JP-A-2011-025479 uses an inkjet head as the printhead. The printhead is configured from a set of four inkjet line heads that respectively eject ink droplets of cyan, black, magenta, and yellow ink, and each inkjet line head is wider than the recording paper. The four inkjet line heads are disposed with a specific gap therebetween in the conveyance direction of the recording paper. The printhead is therefore large both widthwise to the recording paper and in the conveyance direction.

When the printhead is an inkjet head, print quality drops if the gap between the printhead and the platen is not held at a specific predetermined distance. The line printer described in JP-A-2011-025479 therefore has round posts that protrude from the printhead frame toward the platen side, and controls the gap between the printhead and the platen to the height of these posts by setting the bottom distal ends of the posts against the platen surface (the surface opposite the printhead).

When an inkjet head is used as the printhead, the ink nozzle face of the printhead is preferably capped by a head cap when the printer is in the standby mode. Capping can reduce evaporation of moisture from the ink through the ink nozzle face, and can prevent the viscosity of the ink in the nozzles from increasing. A flushing operation that discharges ink droplets from the printhead into the head cap at a regular interval is also desirable. The flushing operation can prevent the ink nozzles from clogging or unclog clogged nozzles.

In order to cap or flush the printhead in a line printer, a printhead standby position could conceivably be set beside the platen, and the printhead could be moved horizontally between a position opposite the platen and the printhead standby position, as in a serial printer. However, the printhead of a line printer may be rather large as described in JP-A-2011-025479. Because the area of the recording paper opposite the printhead at the platen increases when a large printhead is used, the recording paper can easily lift away from the platen when the printhead is retracted from the position opposite the platen. Therefore, when the printhead is then returned to the position opposite the platen, the printhead and the recording paper can collide, easily resulting in damage to the printhead or a paper jam.

To prevent the recording paper from lifting away from the platen, a star wheel or other media separation prevention member that pushes down on the recording paper as the paper passes over the platen may conceivably be provided. However, when such a media separation prevention member is provided, the media separation prevention member and the printhead may collide when the printhead moves horizontally from the printhead standby position to the position opposite the platen.

Furthermore, if the reference surface of the printhead unit (a surface parallel to the ink nozzle face of the printhead) and the platen surface are not parallel in a configuration that maintains the platen gap by setting posts protruding from the printhead unit against the platen surface as described in JP-A-2011-025479, the reference surface of the printhead unit and the surface of the platen are made parallel to each other by contact between the posts and the platen surface, which changes the posture of at least one of the printhead unit and the platen.

When the posture of the printhead unit and the platen changes due to contact between the posts and the platen surface, the posts move against the platen surface and the reference surface and platen are set parallel to each other. If the operation that forms the platen gap is performed repeatedly with the posts moving against the platen surface, the posts or the platen surface may become worn and forming a precise platen gap may not be possible.

SUMMARY

A line printer and a printhead moving method of a line printer according to at least one embodiment of the invention prevent the printhead from colliding with a member such as a media separation prevention member disposed above the platen when a printhead disposed at a printhead standby position offset from the printing position opposite the platen is moved in a direction perpendicular to the direction of opposition between the printhead and the platen and set to the position opposite the platen.

Another object of at least one embodiment of the invention is to provide a line printer that accurately maintains a specific gap between the printhead and the platen.

A line printer according to one aspect of at least one embodiment of the invention has a printhead; a platen; a carriage including a head unit configured to support the printhead and a frame configured to movably support the head unit; a carriage moving mechanism configured to move the carriage between an opposing position where the printhead is opposite the platen, and a standby position where the printhead is not opposite the platen; and a head unit moving mechanism configured to move the head unit in a direction toward the platen when the carriage is set to the opposing position.

Preferably, the frame supports the head unit movably between a first position where the gap between the printhead and the platen is a first distance, and a second position where said gap is a second distance that is shorter than the first distance; and the head unit moving mechanism moves the head unit set to the first position to the second position.

This aspect of the invention supports the head unit that holds the printhead on a frame movably between a first position and a second position. Therefore, when printhead that is set to a position not opposite the platen is moved to a position opposite the platen, the head unit can be set to the first position, and the gap between the printhead and the platen can be set to a large first distance. As a result, when a media separation prevention member that prevents the recording paper on the platen from lifting away from the platen is used, collision between such media separation prevention members and the printhead can be prevented. In addition, after the carriage is set to the opposing position and the printhead moves to the position opposite the platen, the head unit can be moved on the frame from the first position to the second position, and the gap between the printhead and the platen can be reduced. The gap can therefore be set to a distance suitable for printing, for example.

To set the printhead accurately to the opposing position, the head unit moving mechanism preferably moves the carriage in a direction perpendicular to the direction of opposition between the printhead and the platen in another aspect of the invention.

In another aspect of at least one embodiment of the invention, the carriage has an urging member that urges the head unit to the first position; and the head unit moving mechanism moves the head unit in resistance to the urging force of the urging member from the first position to the second position.

Thus comprised, the carriage can be easily moved from the standby position to the opposing position when the head unit is at the first position. Furthermore, because the urging force of the urging member works on the head unit when the head unit moves to the second position, the head unit can be easily returned from the second position to the first position.

Further preferably, the second position is a position where the printhead can print to recording paper on the platen.

This configuration enables printing with the printhead at the second position.

To maintain a desired distance at the gap between the printhead and the platen when the printhead is at the second position, the line printer according to another aspect of the invention preferably also has a gap forming member that sets a specific gap between the printhead and the platen, and contacts both the carriage and the platen when the head unit is at the second position. Further preferably, the gap forming member contacts both the carriage and the platen when the head unit is set to the second position, and creates a constant gap between the printhead and the platen.

To hold the gap between the printhead and the platen at a desired distance when the printhead is at the second position, a gap-forming protrusion is preferably disposed to at least one of the head unit and the platen, and when the head unit is at the second position, the gap-forming protrusion contacts the other one of the head unit and the platen and sets a specific gap between the printhead and the platen.

To enable the head unit to move smoothly from the first position to the second position, the carriage has a guide mechanism that guides movement of the head unit; and the guide mechanism includes a guide channel disposed to one of the head unit and the frame, and a guide roller that is disposed on the other of the head unit and the frame and is inserted in the guide channel.

Further preferably, the guide channel extends in the direction of opposition between the printhead and the platen, and includes a first channel section having a first channel width that is the same as the diameter of the guide roller, and a second channel section having a second channel width that is greater than the first channel width; a first guide roller and a second guide roller are disposed as guide rollers; and when the head unit moves between the first position and the second position, the first guide roller moves through the first channel section, and the second guide roller moves through the second channel section.

Because the second guide roller can move in the second channel section in a direction of opposition that intersects the direction in which the guide channel is aligned, the posture of the head unit on the frame can be changed. Therefore, when the head unit is set to the second position and the ink nozzle face of the printhead and the platen surface (the surface of the platen facing the printhead) are not parallel, the head unit tilts on the frame as a result of contact between the head unit and the gap-forming protrusion, contact between the gap-forming protrusion disposed to the head unit and the platen, or contact between the gap-forming protrusion disposed to the platen and the head unit, and the ink nozzle face of the printhead and the platen surface can be made parallel to each other. A constant gap can also be set between the printhead and the platen.

To achieve the foregoing object, a line printer according to another aspect of at least one embodiment of the invention has a platen opposite a printhead; a head unit that holds the printhead; and a bearing ball that is disposed between the head unit and the platen, wherein the bearing ball contacts the head unit and the platen, and sets a constant gap between the head unit and the platen.

A bearing ball is preferably disposed between the head unit and the platen to always maintain a constant gap between the printhead and the platen. Because the contact area of a bearing ball with the other member is small, wear between the head unit and the platen can be prevented or suppressed when the gap is formed. As a result, a precise specific gap can be formed even when the operation of forming the gap repeats.

Further preferably, the line printer also has a holding frame that holds the bearing ball so that the bearing ball can roll. Because the bearing ball can roll in this aspect of the invention, the bearing ball can move easily against the head unit, and the bearing ball can move easily against the platen. Because wear between the bearing ball and the head unit, and wear between the bearing ball and the platen, are reduced as a result, wear on the head unit and the platen can be prevented or suppressed when the specific gap is formed.

Further preferably in another aspect of at least one embodiment of the invention, the holding frame holds the bearing ball movably in a direction intersecting the direction between the printhead and the platen.

This configuration enables the bearing ball to roll and move against the head unit, and enable the bearing ball to roll and move against the platen. Because wear between the bearing ball and the head unit, and wear between the bearing ball and the platen, are reduced as a result, wear on the head unit and the platen can be prevented or suppressed when the specific gap is formed.

Further preferably, there are at least three bearing balls disposed to mutually separated positions; and the holding frame holds each of the bearing balls at a position not on a line joining the other two bearing balls.

The reference surface of the head unit and the surface of the platen can be easily made parallel with this configuration by setting the three bearing balls held at said positions in contact with the head unit and the platen.

In order to hold the bearing balls so that they can roll in this configuration, the holding frame preferably has a ball holding unit that holds the bearing ball; and the ball holding unit has a through-hole that extends in a direction extending between the printhead and the platen to which the bearing ball is partially inserted, and a support member that spans the opening on one side of the through-hole in this direction at the edge of the opening, and can contact the bearing ball from the one side.

Further preferably, the line printer has a moving mechanism that moves the head unit between a first position where the gap is a first distance, and a second position where the gap is a second distance that is shorter than the first distance. The holding frame holds the bearing ball in contact with the platen; and the head unit contacts the bearing ball when set to the second position.

Thus comprised, the bearing balls disposed between the head unit and the platen can easily contact both the head unit and the platen.

Further preferably, the line printer also has an urging member that urges either the head unit or the platen to the other through the bearing ball.

Thus comprised, when the reference surface of the head unit and the platen surface are not parallel when both the head unit and the platen contact the bearing balls, the urging force of the urging mechanism causes the posture of at least one of the head unit and the platen to change, and the reference surface of the head unit and the platen surface can be made parallel. A specific gap can also be maintained by the urging force of the urging mechanism.

The line printer further preferably includes a platen support mechanism that supports the platen movably between a reference position opposite the printhead, and a retracted position that is different from the reference position; and the holding frame is set to a position causing the bearing ball to contact the platen when the platen is at the reference position, and separates the bearing ball from the platen when the platen is at the retracted position.

When the recording paper jams between the holding frame and the platen, for example, this configuration enables moving the platen from the reference position to the retracted position, thereby separates the holding frame and the platen, and enables removing the recording paper that is stuck therebetween. Furthermore, because the bearing balls are held by the holding frame so that they can roll, when the platen is moved from the reference position to the retracted position, friction between the bearing balls and the platen, or friction between the bearing balls and the jammed recording paper, is reduced. The platen can therefore be easily moved to the retracted position, and jammed recording paper can be easily removed.

Another aspect of at least one embodiment of the invention is a printhead moving method of a line printer, including: setting a printhead at a printhead standby position not opposite a platen to a head-opposing position opposite the platen; and moving the printhead in the direction toward the platen at the head-opposing position.

Further preferably, the printhead moving method of a line printer also includes: moving the printhead from the standby position to the head-opposing position while holding the gap between the platen and the printhead at a first distance; and moving the printhead between the printhead and the platen to a second distance that is shorter than the first distance.

As a result, when a media separation prevention member that prevents the recording paper on the platen from lifting away from the platen is used, collision between such media separation prevention members and the printhead can be prevented. In addition, after the printhead moves to the position opposite the platen, the head unit can be moved toward the platen, and the gap therebetween can be reduced to the second distance. Printing with the printhead can therefore start if the second distance is a distance suitable for printing.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a line printer according to the present invention is described below with reference to the accompanying figures.

General Configuration

Figure 1:
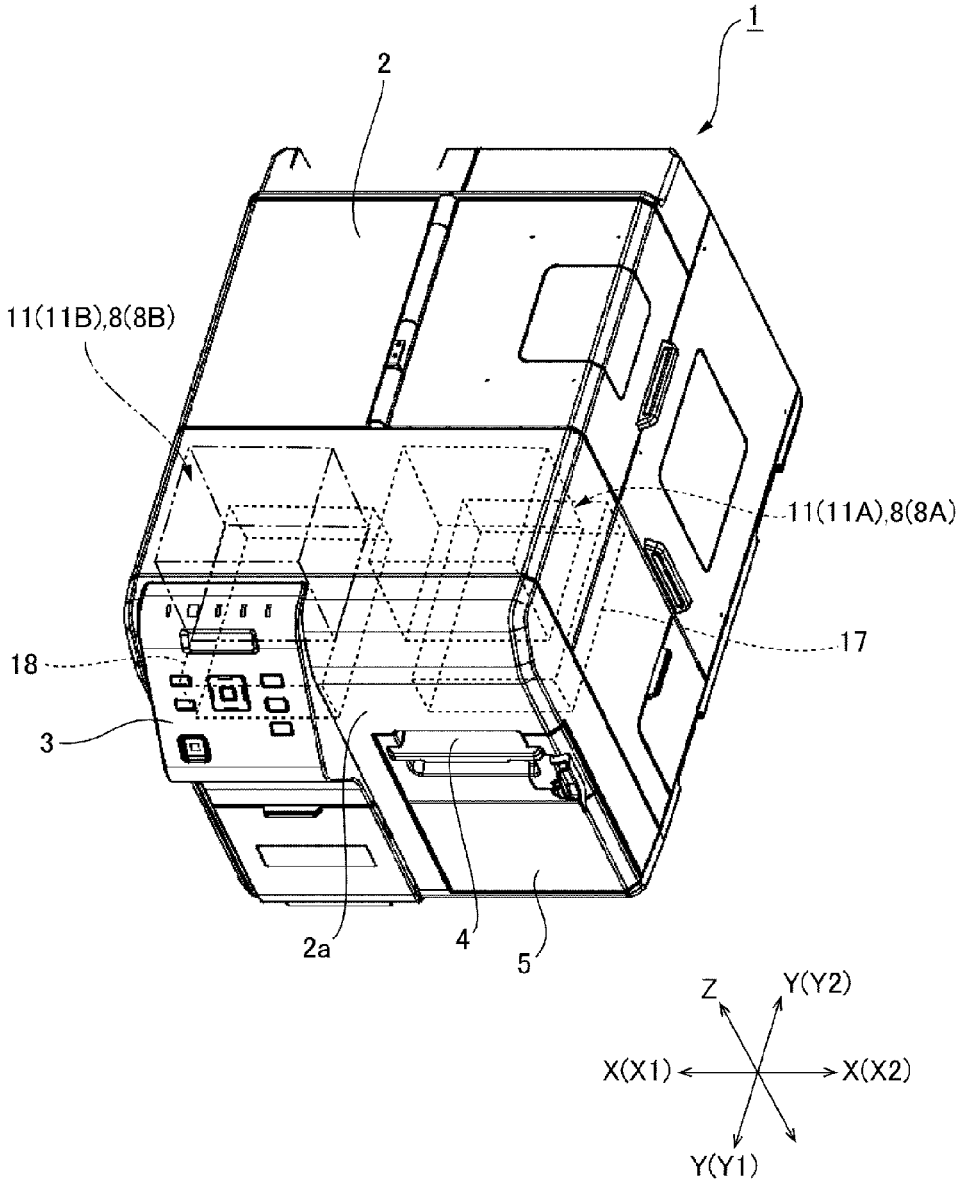
FIG. 1 is an external oblique view of a line printer according to the invention.
Figure 2:
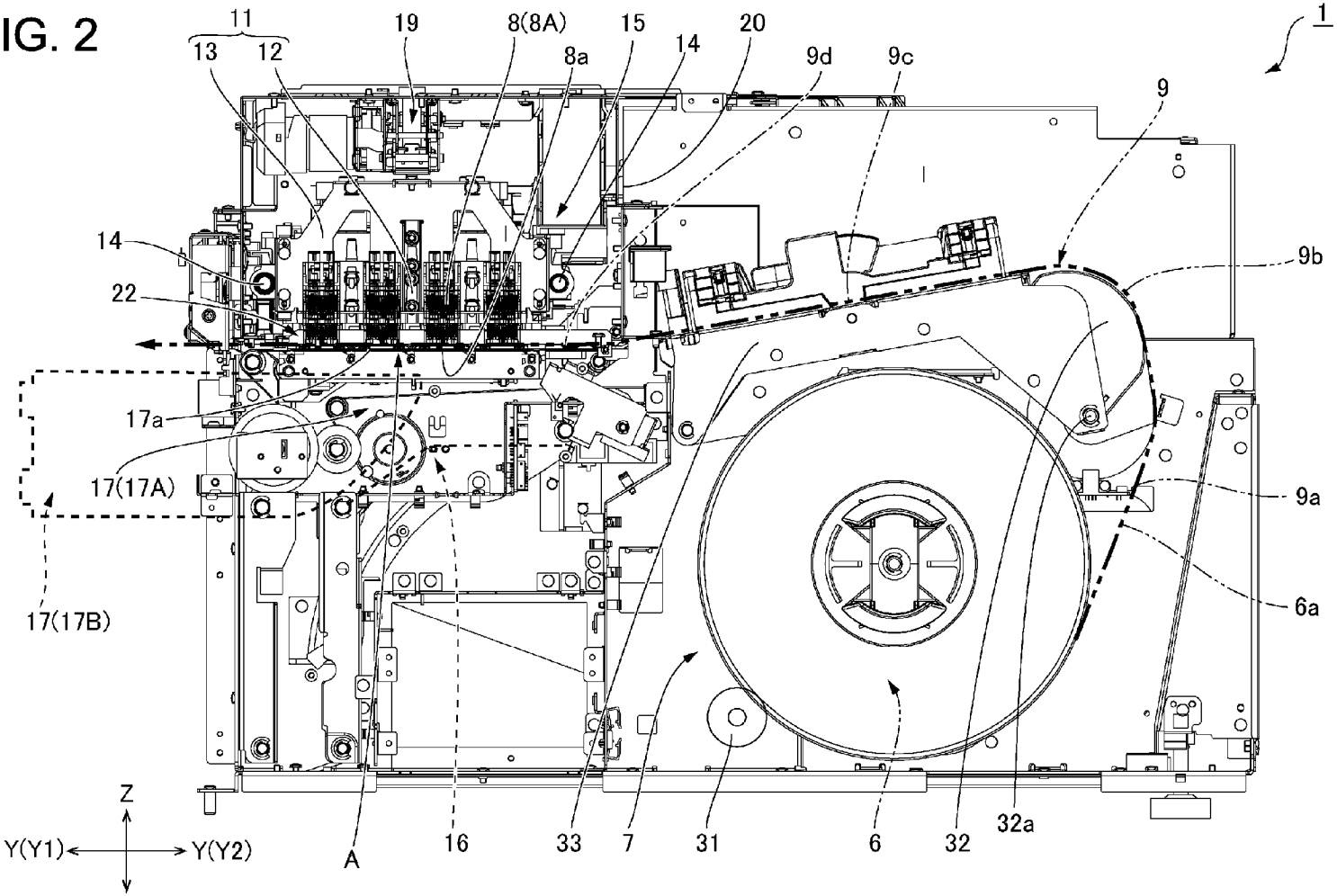
FIG. 2 is a vertical section view showing the internal configuration of the line printer in FIG. 1.

FIG. 1 is an external oblique view of a line printer according to the invention. FIG. 2 is a vertical section view showing the internal configuration of the line printer.

As shown in FIG. 1, the line printer 1 has a printer cabinet 2 that is basically box-shaped and is long from front to back. An operating panel 3 is disposed to one side of the transverse axis X at the top of the front 2*a* of the printer cabinet 2, and a paper exit 4 is formed on the other side. An access cover 5 for maintenance is disposed below the paper exit 4.

As shown in FIG. 1, the invention is described below with reference to three mutually perpendicular directional axes, the transverse axis X across the device width, a longitudinal axis Y, and a vertical axis Z.

As shown in FIG. 2, a roll paper compartment 7 for holding a paper roll 6 is at the bottom back area inside the printer cabinet 2. A paper conveyance path 9 is also formed inside the printer cabinet 2 from the roll paper compartment 7 to the paper exit 4 past the print position A of the printhead 8.

The paper conveyance path 9 includes a first conveyance path section 9*a* that extends diagonally upward toward the printer back Y2 (the back of the printer on the longitudinal axis Y) from the roll paper compartment 7; a second conveyance path section 9*b* that curves from the top end of the first conveyance path section 9*a* toward the printer front Y2 (the front of the printer on the longitudinal axis Y); a third conveyance path section 9*c* that descends gradually from the front end of the second conveyance path section 9*b* toward the printer front Y1; and a fourth conveyance path section 9*d* that extends horizontally from the front end of the third conveyance path section 9*c* toward the printer front Y1.

The printhead 8 is disposed near the top at the front of the printer cabinet 2. The printhead 8 can be an inkjet head and is mounted on a carriage 11 with the ink nozzle face 8*a* facing down. The carriage 11 includes a head unit 12 that holds the printhead 8, and a carriage frame 13 (also referred to below as simply the frame) that supports the head unit 12 movably on the vertical axis Z. The printhead 8 and carriage 11 are located above the fourth conveyance path section 9*d*. The print position A is also located on the fourth conveyance path section 9*d*, and is defined by a platen unit (platen) 17 disposed below the printhead 8.

A pair of parallel carriage guide rails 14 are disposed extending on the transverse axis X with the carriage 11 therebetween on the longitudinal axis Y. A carriage moving mechanism 15 is disposed on the printer back Y2 side of the printhead 8, and the carriage moving mechanism 15 moves the carriage 11 along the pair of carriage guide rails 14.

The carriage 11 moves between the opposing position 11A indicated by the dotted line in FIG. 1, and the standby position 11B indicated by the double-dotted line in FIG. 1.

At the opposing position 11A, the printhead 8 mounted on the carriage 11 is opposite the platen unit 17. More specifically, when the carriage 11 is set to the opposing position 11A, the printhead 8 is at the opposing head position 8A opposite the platen unit 17 as shown in FIG. 2.

At the standby position 11B, the printhead 8 mounted on the carriage 11 is not opposite the platen unit 17. More specifically, when the carriage 11 is set to the standby position 11B, the printhead 8 is set to the head standby position 8B separated from the opposing head position 8A in a first direction X1 (the direction to one side of the printer width). A head maintenance unit 18 is disposed below the head standby position 8B, and the printhead 8 is opposite the head maintenance unit 18 when the printhead 8 is set to the head standby position 8B. The head maintenance unit 18 includes a head cap that can cover the ink nozzle face 8*a* of the printhead 8 set to the head standby position 8B. Ahead unit moving mechanism 19 (urging mechanism, moving mechanism) that lowers the head unit 12 when the carriage 11 is set to the opposing position 11A is disposed above the carriage 11.

The platen unit 17 has a platen surface 17*a* that is opposite and parallel to the ink nozzle face 8*a* of the printhead 8. The platen surface 17*a* defines the fourth conveyance path section 9*d*. The platen surface 17*a* comprises the horizontal belt portion 21*a* of a conveyance belt 21 described below. The platen unit 17 is supported by a platen support mechanism 16 movably between the a reference position 17A opposite the printhead 8, and a retracted position 17B separated to the printer front Y1 and below the platen unit 17. The position of the platen unit 17 when in the reference position 17A is indicated by the solid line in FIG. 2, and the platen surface 17*a* defines the fourth conveyance path section 9*d*. The position of the platen unit 17 when in the retracted position 17B is indicated by the dotted line in FIG. 2, and the platen unit 17 protrudes to the front from the printer cabinet 2 when the access cover 5 is open.

The platen support mechanism 16 supports the platen unit 17 on both sides of the transverse axis X, and has a pair of guide rails that guide movement of the platen unit 17 between the reference position 17A and the retracted position 17B. Note that the platen unit 17 is normally disposed at the reference position 17A. The platen unit 17 is set to the retracted position 17B to remove the recording paper 6*a* when a paper jam occurs at the print position A, for example.

A gap forming unit 22 is disposed between the head unit 12 and the platen unit 17. The gap forming unit 22 has three ball bearings (bearing balls) 23 to 25 (gap forming members) (see FIG. 12A) that contact both the head unit 12 and the platen unit 17, and maintain the platen gap G between the printhead 8 and the platen unit 17 at a predetermined gap dimension.

A paper supply roller 31 is disposed at the bottom of the roll paper compartment 7. The paper supply roller 31 is held in constant contact from below with the paper roll 6 set in the roll paper compartment 7. The paper supply roller 31 is driven by a supply motor (not shown in the figure). When the paper supply roller 31 is driven, continuous recording paper 6*a* is delivered from the paper roll 6 to the first conveyance path section 9*a*.

A tension lever 32 that applies back tension to the recording paper 6*a* conveyed through the paper conveyance path 9 is disposed at the second conveyance path section 9*b*. The tension lever 32 defines the second conveyance path section 9*b*, and has a curved outside surface that projects toward the printer back Y2. The bottom end of the tension lever 32 is pivotably attached to an axle 32*a* extending on the transverse axis X, and is urged toward the printer back Y2 by a spring member (not shown in the figure).

A paper guide 33 is disposed on the side of the tension lever 32 at the printer front Y1. The paper guide 33 defines the third conveyance path section 9*c*, and is shaped to slope gradually down toward the printer front Y1.

Figure 3:
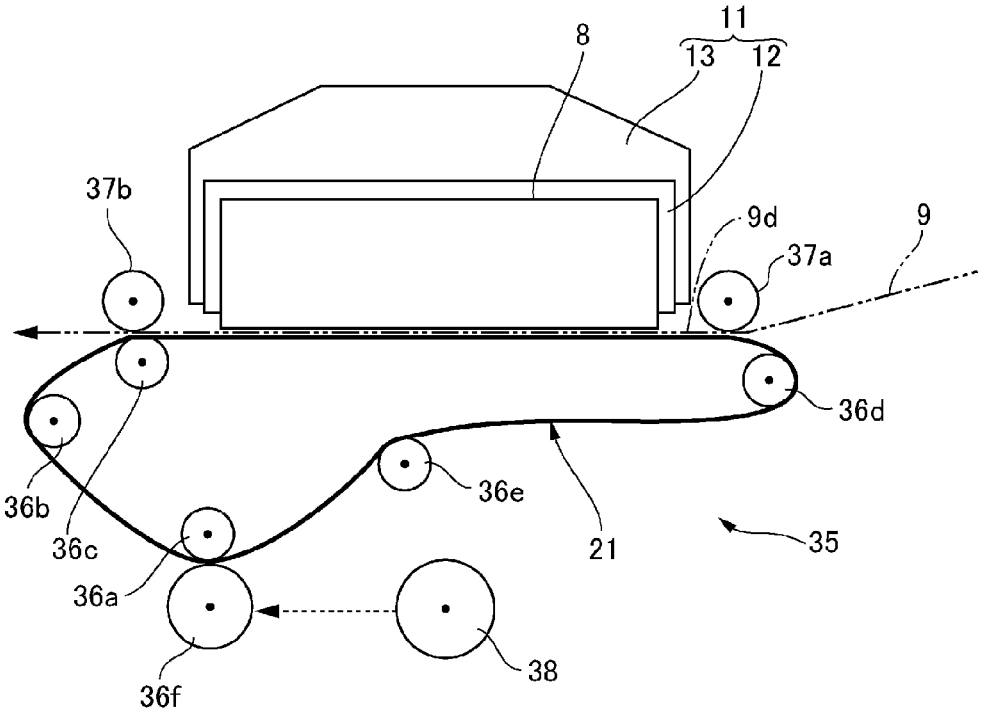
FIG. 3 schematically illustrates the paper conveyance mechanism.

A belt-type paper conveyance mechanism 35 is mounted on the platen unit 17. FIG. 3 illustrates the paper conveyance mechanism 35. The paper conveyance mechanism 35 includes a conveyance belt 21, which is an endless belt disposed below the printhead 8; a plurality of guide rollers 36*a* to 36*e* on which the conveyance belt 21 is mounted; a drive roller 36*f* that drives the conveyance belt 21; and a conveyance motor 38 that drives the drive roller 36*f* rotationally. The conveyance belt 21 is pressed against the drive roller 36*f* by guide roller 36*a*. When the drive roller 36*f* turns, the conveyance belt 21 is conveyed along a path passing each of the guide rollers 36*a* to 36*e*.

The part of the conveyance belt 21 between guide rollers 36*c* and 36*d* is the horizontal belt portion 21*a* that extends horizontally through the fourth conveyance path section 9*d*. Pinch rollers 37*a* and 37*b* are pressed from above the platen unit 17 to the upstream end and the downstream end of the horizontal belt portion 21*a* in the conveyance direction (the longitudinal axis Y). The paper conveyance mechanism 35 holds and conveys the recording paper 6*a* between the pinch rollers 37*a* and 37*b* and the horizontal belt portion 21*a*.

As shown in FIG. 2, the recording paper 6*a* is pulled from the paper roll 6 set in the roll paper compartment 7 through the first conveyance path section 9*a* of the paper conveyance path 9. The recording paper 6*a* is threaded around the tension lever 32, curves to the front along the second conveyance path section 9*b*, and is set with the leading end passing through the third conveyance path section 9*c* and the fourth conveyance path section 9*d*. A paper supply operation is then executed by the paper supply roller 31, a conveyance operation is executed by the paper conveyance mechanism 35, and an indexing operation that sets the leading end of the recording paper 6*a* to the print position A of the printhead 8 is executed. A conveyance operation whereby the paper conveyance mechanism 35 continuously feeds the recording paper 6*a* from the print position A forward at a constant speed toward the paper exit 4 is then executed. Synchronized to this conveyance operation, driving the printhead 8 is controlled to print on the surface of the recording paper 6*a* passing the print position A.

Printhead and Carriage

Figure 4:
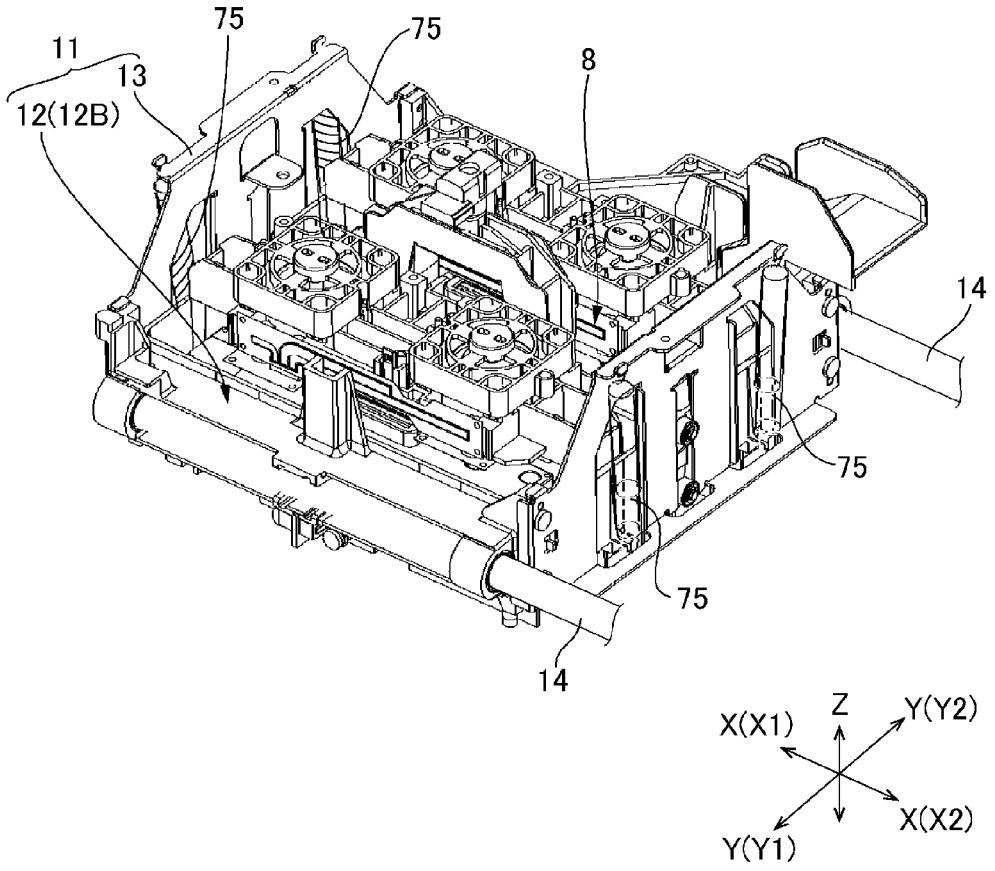
FIG. 4 is an oblique view of the carriage that carries the printhead.
Figure 5:
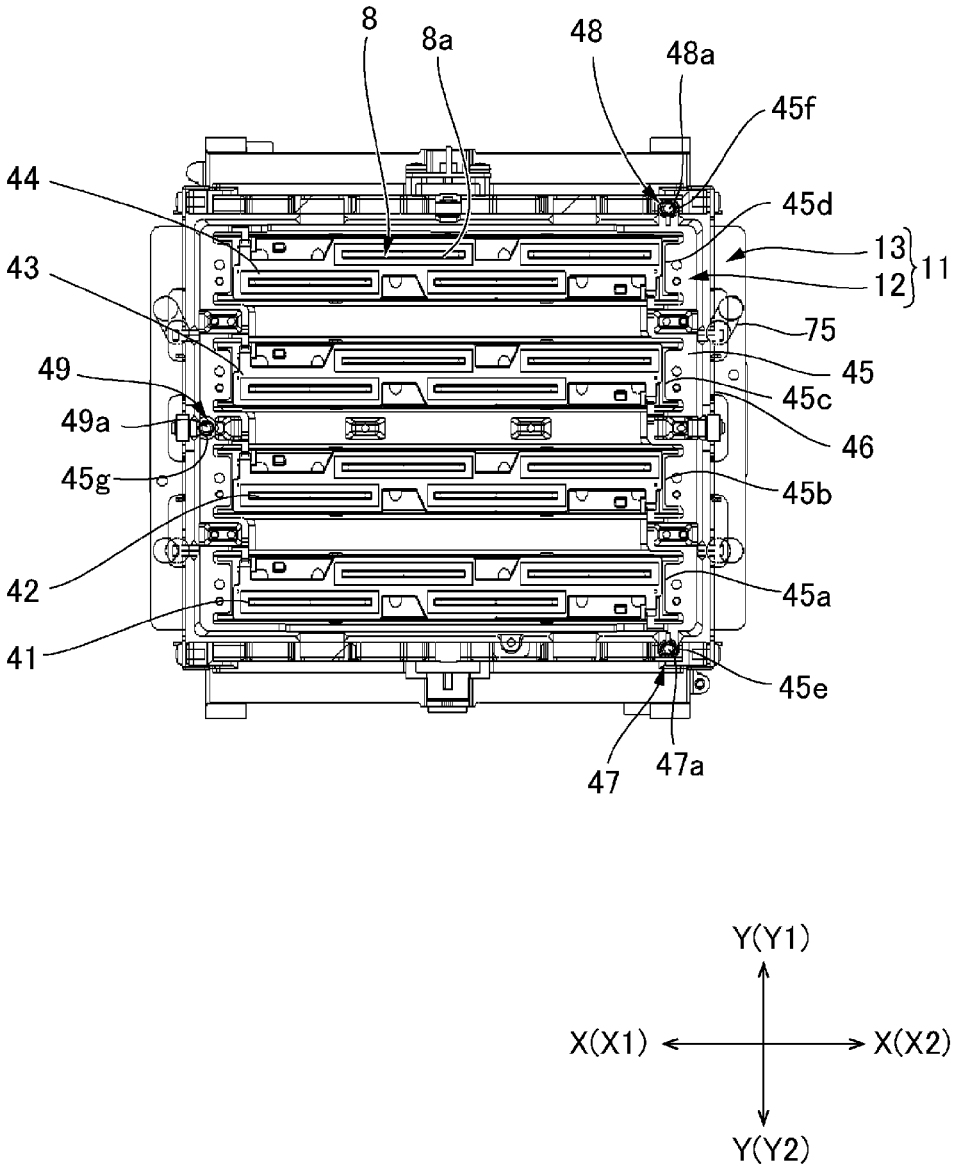
FIG. 5 is a bottom view from below of the carriage that carries the printhead.
Figure 6A:
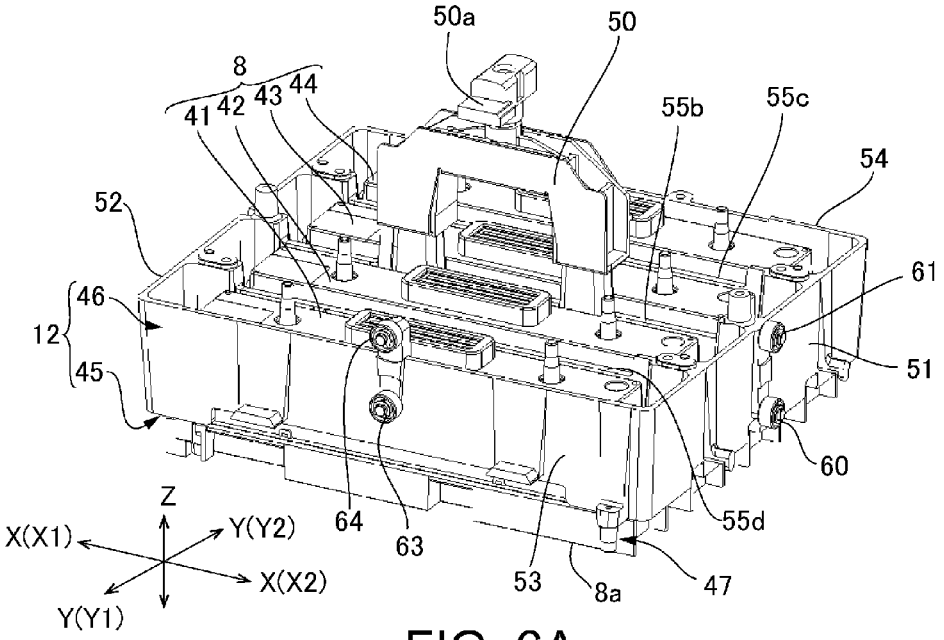
FIGS. 6A and 6B are oblique views of the head unit that holds the printhead.
Figure 6B:
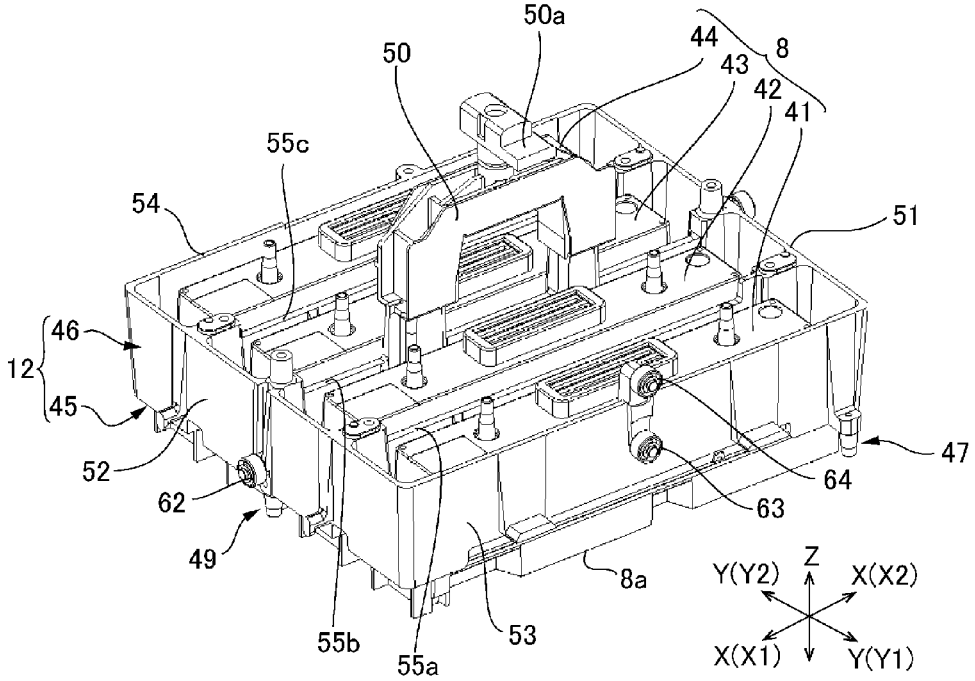
Figure 7:
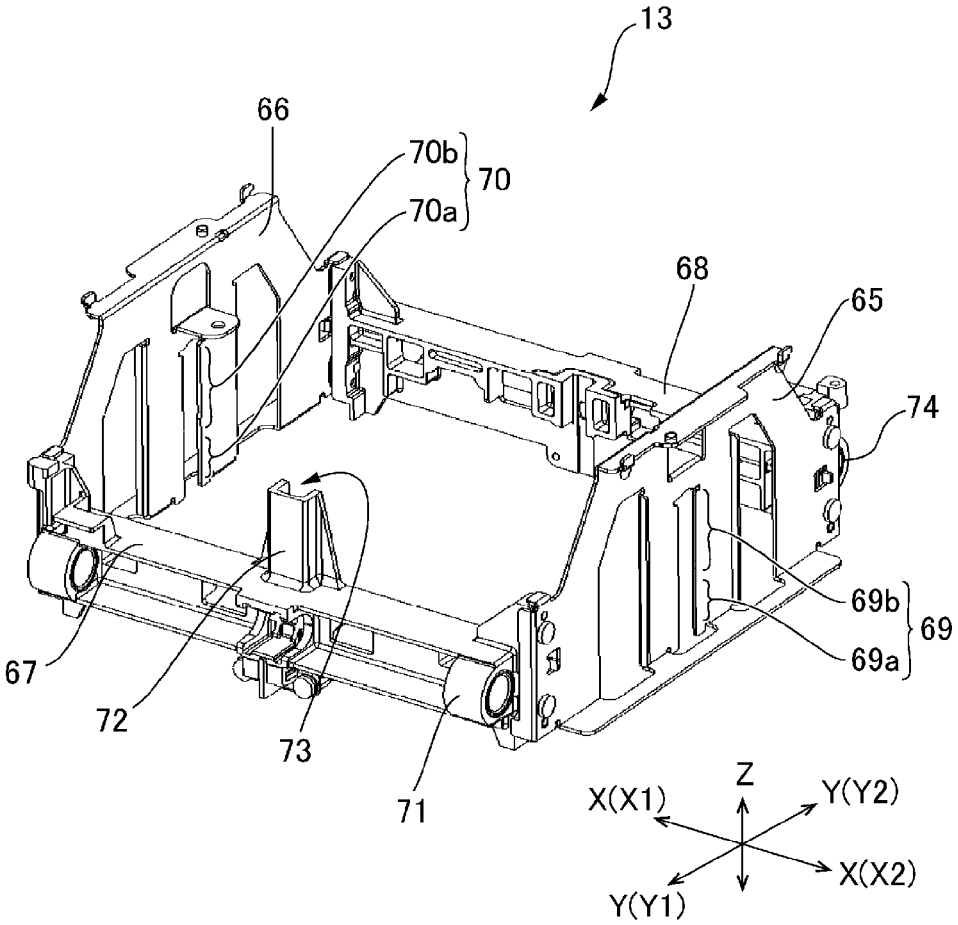
FIG. 7 is an oblique view of the carriage frame.

FIG. 4 is an oblique view of the carriage 11 with the printhead 8 mounted thereon. FIG. 5 is a bottom view of the printhead 8 and the carriage 11 from the platen unit 17 side. FIG. 6A and FIG. 6B are oblique views of the head unit 12 that supports the printhead 8 from one side and the other side on the transverse axis X. FIG. 7 is an oblique view of the carriage frame 13 that supports the head unit 12 from one side on the transverse axis X.

As shown in FIG. 5 and FIGS. 6A and 6B, the printhead 8 has a set of four inkjet line heads 41 to 44. Each of the inkjet line heads 41 to 44 is wider than the width of the recording paper 6*a* conveyed through the paper conveyance path 9, and are rectangularly shaped overall with the long side on the transverse axis X. The four inkjet line heads 41 to 44 respectively eject black ink, cyan ink, magenta ink, and yellow ink.

As shown in FIGS. 6A and 6B, the head unit 12 has a rectangular bottom 45, a side wall unit 46 that rises vertically from the outside edges of the bottom 45, and an operating unit 50 that protrudes from the center part of the bottom 45 to a height above the top of the side wall unit 46.

As shown in FIG. 5, four rectangular openings 45*a* to 45*d* that are long on the transverse axis X are formed in the bottom 45. The openings 45*a* to 45*d* are disposed at a constant interval on the longitudinal axis Y. The inkjet line heads 41 to 44 are inserted from above to the side wall unit 46, and are held in the head unit 12 with the bottom parts of the heads protruding down from the openings 45*a* to 45*d*. As a result, the four inkjet line heads 41 to 44 are arranged at a constant interval on the longitudinal axis Y.

As shown in FIG. 5, first to third carriage-side stops 47 to 49 that can contact the three ball bearings 23 to 25 of the gap forming unit 22 are disposed at the bottom 45. The first carriage-side stop 47 is disposed at a protrusion 45*e* that protrudes forward from the front edge of the end of the bottom 45 in the second direction X2 (the direction to the other side of the printer width). The second carriage-side stop 48 is disposed at a protrusion 45*f* that protrudes toward the back from the back edge of the end of the bottom 45 in the second direction X2. The third carriage-side stop 49 is disposed at an edge part 45*g* of the bottom 45 at the middle on the longitudinal axis Y. The positions where the first carriage-side stop 47 and the second carriage-side stop 48 are disposed are positions removed to the outside in the second direction X2 from the printhead 8, and the position of the third carriage-side stop 49 is a position removed to the outside in the first direction X1 from the printhead 8.

As shown in FIGS. 6A and 6B, the first to third carriage-side stops 47 to 49 are round posts that protrude down. The bottom ends of the first to third carriage-side stops 47 to 49 are flat, and as shown in FIGS. 6A and 6B are positioned above the ink nozzle face 8*a* of the printhead 8 on the vertical axis Z. The virtual plane defined by the bottom ends 47*a*, 48*a*, 49*a* of the three carriage-side stops 47 to 49 is a plane parallel to the ink nozzle face 8*a* of the printhead 8, and is the reference surface 12*a* of the head unit 12 (see FIGS. 15A and 15B).

As shown in FIGS. 6A and 6B, the side wall unit 46 has a first wall section 51 extending along the longitudinal axis Y outside the printhead 8 in the second direction X2; a second wall section 52 on the opposite side as the first wall section 51 with the printhead 8 therebetween in the direction of the transverse axis X; a third wall section 53 that extends along the transverse axis X and connects the front end parts of the first wall section 51 and the second wall section 52; and a fourth wall section 54 that extends along the transverse axis X and connects the back end parts of the first wall section 51 and the second wall section 52.

Three reinforcing panels 55*a* to 55*c* that connect the first wall section 51 and the second wall section 52 are disposed between the inkjet line heads 41 to 44 arranged on the longitudinal axis Y inside the side wall unit 46. Of the three reinforcing panels 55*a* to 55*c*, the reinforcing panel 55*b* in the center along the longitudinal axis Y is formed in unison with the operating unit 50. A stop 50*a* that contacts the operating lever 77 (see FIG. 8) of the head unit moving mechanism 19 is disposed to the top part of the operating unit 50.

A first bottom guide roller 60 (first guide roller) and a first top guide roller 61 (second guide roller) are disposed on the first wall section 51 in the center on the longitudinal axis Y as shown in FIG. 6A. The first bottom guide roller 60 and first top guide roller 61 are disposed with their axes of rotation aligned with the transverse axis X and separated from each other on the vertical axis Z. The first bottom guide roller 60 is located below the first top guide roller 61.

A second guide roller 62 is disposed on the second wall section 52 at the middle on the longitudinal axis Y as shown in FIG. 6B. The second guide roller 62 is disposed coaxially to the first bottom guide roller 60 along the transverse axis X.

A third bottom guide roller 63 (first guide roller) and a third top guide roller 64 (second guide roller) are disposed on the third wall section 53 in the middle on the transverse axis X. The third bottom guide roller 63 and third top guide roller 64 are disposed with their axes of rotation on the longitudinal axis Y and separated from each other on the vertical axis Z. The third bottom guide roller 63 is located below the third top guide roller 64. The third bottom guide roller 63 is also located on the vertical axis Z between the first bottom guide roller 60 and the first top guide roller 61. The third top guide roller 64 is located above the first top guide roller 61 along the vertical axis Z. The guide rollers 61 to 65 are identical and have substantially the same diameter.

As shown in FIG. 7, the carriage frame 13 is shaped like a picture frame, and supports the head unit 12 on the inside of the frame. The carriage frame 13 has a first carriage frame part 65 on the outside of the first wall section 51 in the second direction X2; a second carriage frame part 66 on the outside of the second wall section 52 in the first direction X1; a third carriage frame part 67 located on the printer front Y1 side of the third wall section 53; and a fourth carriage frame part 68 located on the printer back Y2 side of the fourth wall section 54.

As shown in FIG. 7, a first guide channel 69 is formed so that is extends in the direction of the vertical axis Z in the first carriage frame part 65. The first guide channel 69 includes a first channel section 69*a* at the bottom and a second channel section 69*b* at the top. The first channel section 69*a* has a first channel width that is the same as the diameter of the second guide roller 62. The second channel section 69*b* has a second channel width that is greater than the first channel width.

A second guide channel 70 extending on the vertical axis Z is formed in the second carriage frame part 66. As shown in FIG. 7, the second guide channel 70 has the same shape as the first guide channel 69. More specifically, the second guide channel 70 has a first channel section 70*a* at the bottom with a first channel width that is the same as the diameter of the second guide roller 62, and a second channel section 70*b* with a second channel width that is greater than the first channel width.

A front support 71 that is supported by the one of the pair of carriage guide rails 14 located at the printer front Y1 is also disposed on the third carriage frame part 67. A protrusion 72 that projects up from the front support 71 is also disposed on the third carriage frame part 67.

A third guide channel 73 extending along the vertical axis Z is formed on the back side of the protrusion 72. This third guide channel 73 also has a first channel section 73*a* at the bottom with the same first channel width as the diameter of the second guide roller 62, and a second channel section 73*b* with a second channel width that is greater than the first channel width. See FIGS. 14A and 14B and FIGS. 15A and 15B.

A back support 74 that is supported by one of the pair of carriage guide rails 14 located at the printer back Y2 is disposed on the fourth carriage frame part 68.

When the head unit 12 is placed inside the carriage frame 13, as shown in FIG. 4, the first bottom guide roller 60 and first top guide roller 61 are inserted into the first guide channel 69, and the second guide roller 62 is inserted to the second guide channel 70. The third bottom guide roller 63 and third top guide roller 64 are also inserted to the third guide channel 73. As a result, the head unit 12 is supported by the carriage frame 13 movably between an up position 12A (first position) where the first top guide roller 61 is in the top part of the first guide channel 69, and a down position 12B (second position) where the first bottom guide roller 60 is in the bottom part of the first guide channel 69. Four coil springs 75 (urging members) are disposed between the head unit 12 and the carriage frame 13. The head unit 12 is urged to the up position 12A by the urging force of the four coil springs 75.

The carriage moving mechanism 15 that moves the carriage 11 on the transverse axis X between the opposing position 11A and the standby position 11B may use the same mechanism used to move the printhead in a serial printer. For example, the carriage moving mechanism 15 may be configured with a pair of timing pulleys, a timing belt, and a carriage motor. The pair of timing pulleys are disposed near the opposite ends of the back carriage guide rail 14. The timing belt is mounted on this pair of timing pulleys, and is attached at one place to the carriage 11. The drive power of the carriage motor is transferred to one of the timing pulleys. When the carriage motor is driven, the one timing pulley turns and the timing belt moves. As a result, the carriage 11 moves along the pair of carriage guide rails 14.

Head Unit Moving Mechanism

Figure 8:
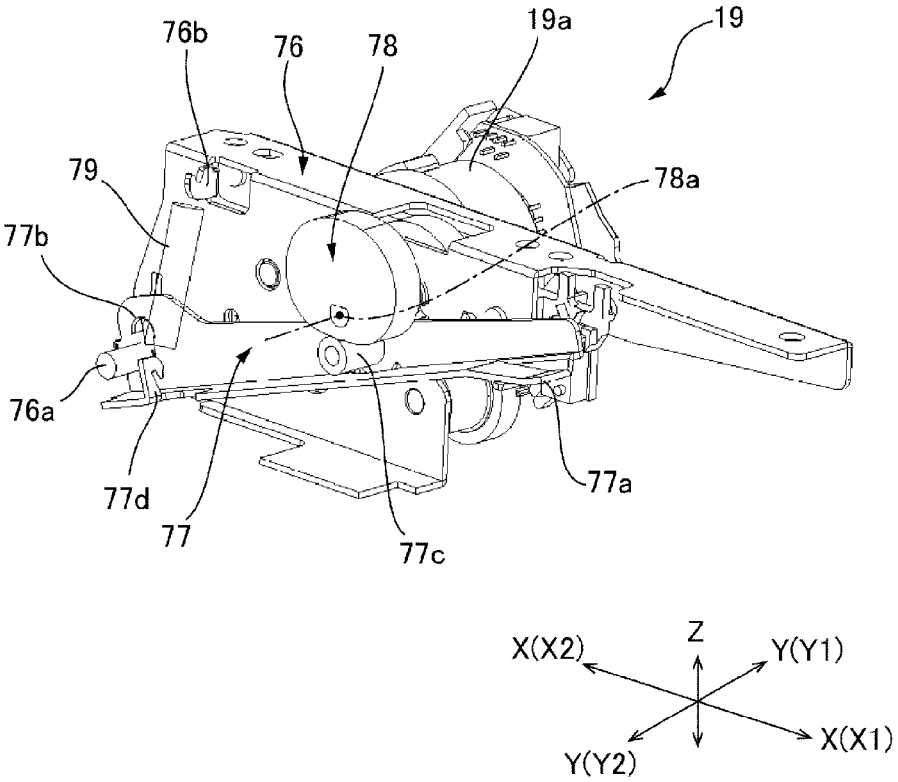
FIG. 8 is an oblique view of the head unit moving mechanism.
Figure 9A:
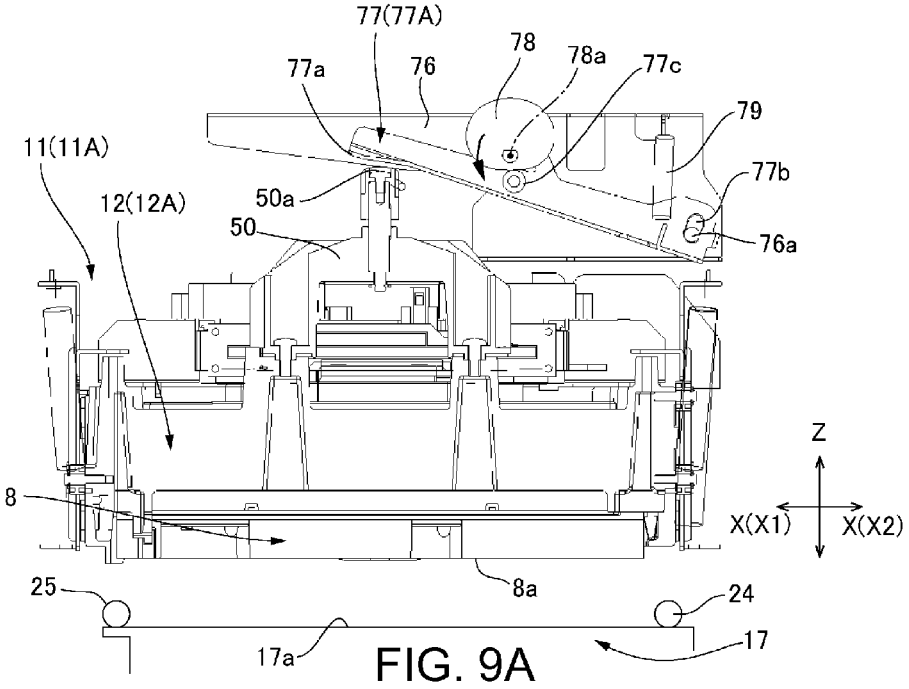
FIGS. 9A and 9B illustrate the head unit lifting operation of the head unit moving mechanism.
Figure 9B:
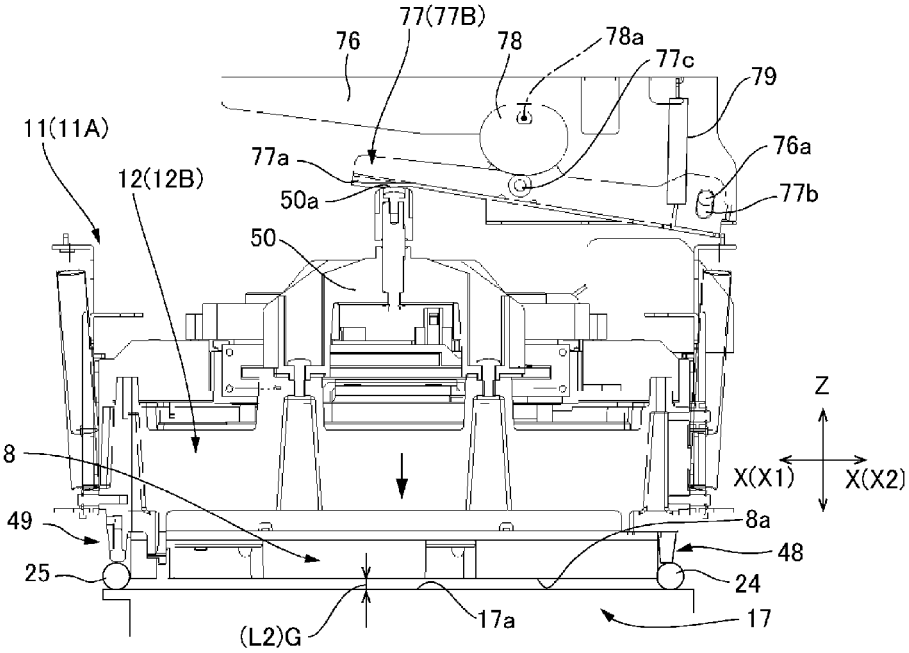

FIG. 8 is an oblique view of the head unit moving mechanism 19. FIGS. 9A and 9B illustrate the head unit 12 lifting operation of the head unit moving mechanism 19.

As shown in FIG. 8, the head unit moving mechanism 19 includes a frame 76 with a support pin 76*a* extending to the printer back Y2; an operating lever 77 extending in the direction of the transverse axis X; an eccentric cam 78 disposed above the support pin 76*a* and the operating lever 77; a cam drive motor 19*a* as the drive source of the eccentric cam 78; and a coil spring 79.

The operating lever 77 has an operating part 77*a* at the end towards the first direction X1 that can contact the operating unit 50 of the head unit 12, and an oval hole 77*b* at the end toward the second direction X2. The support pin 76*a* is inserted to the oval hole 77*b*. A cam follower 77*c* that contacts the cam surface (outside surface) of the eccentric cam 78 is disposed between the operating part 77*a* and the oval hole 77*b* of the operating lever 77. A catch 77*d* for the coil spring 79 is disposed near the oval hole 77*b* between the cam follower 77*c* and the oval hole 77*b*. The coil spring 79 urges the operating lever 77 up, and pushes the cam follower 77*c* against the eccentric cam 78.

When the cam drive motor 19*a* is driven, the eccentric cam 78 turns. As the eccentric cam 78 turns, the cam follower 77*c* that slides against the cam surface moves up and down. As a result, the operating lever 77 moves between the lever-up position 77A where the operating part 77*a* is positioned above the axis of rotation 78*a* of the eccentric cam 78 as shown in FIG. 9A, and the lever-down position 77B where the operating part 77*a* is lower than the axis of rotation 78*a* of the eccentric cam 78 as shown in FIG. 9B. When the head unit moving mechanism is in the initial position, the operating lever 77 is set to the lever-up position 77A.

When the carriage 11 is set to the opposing position 11A, the cam drive motor 19*a* is driven, and the operating lever 77 set to the lever-up position 77A as shown in FIG. 9A descends, the operating part 77*a* contacts the operating unit 50 of the head unit 12 and pushes the head unit 12 down. As a result, the head unit 12 set to the up position 12A moves down in resistance to the urging force of the coil springs 75. The head unit 12 also moves to the down position 12B as shown in FIG. 9B before the operating lever 77 reaches the lever-down position 77B.

When the head unit 12 is at the down position 12B, the three ball bearings 23 to 25 of the gap forming unit 22 contact both the head unit 12 and the platen unit 17, and a platen gap G of a specific distance L2 (second distance) is created between the printhead 8 and the platen surface 17*a*. If the force pushing the head unit 12 to the platen unit 17 through the operating lever 77 is excessive when forming the platen gap G, the operating lever 77 moves relative to the support pin 76*a*, thus relieving the excessive force. More specifically, when the operating lever 77 is set to the lever-down position 77B, the oval hole 77*b* extends vertically, and the part of the operating lever 77 near the oval hole 77*b* is held by the coil spring 79 so that the operating lever 77 can be vertically displaced.

Therefore, when the force of the operating lever 77 pushing the head unit 12 to the platen unit 17 is excessive, the end of the operating lever 77 in the second direction X2 where the oval hole 77*b* is formed moves down relative to the support pin 76*a*, relieving the excess force on the head unit 12.

When the cam drive motor 19*a* is driven from the position shown in FIG. 9B, the operating lever 77 returns from the down position 12B to the lever-up position 77A shown in FIG. 9A. The head unit 12 is raised by the urging force of the coil springs 75 while the operating lever 77 rises toward the lever-up position 77A. Therefore, when the operating lever 77 returns to the lever-up position 77A, the head unit 12 returns to the up position 12A.

Platen Unit

Figure 10:
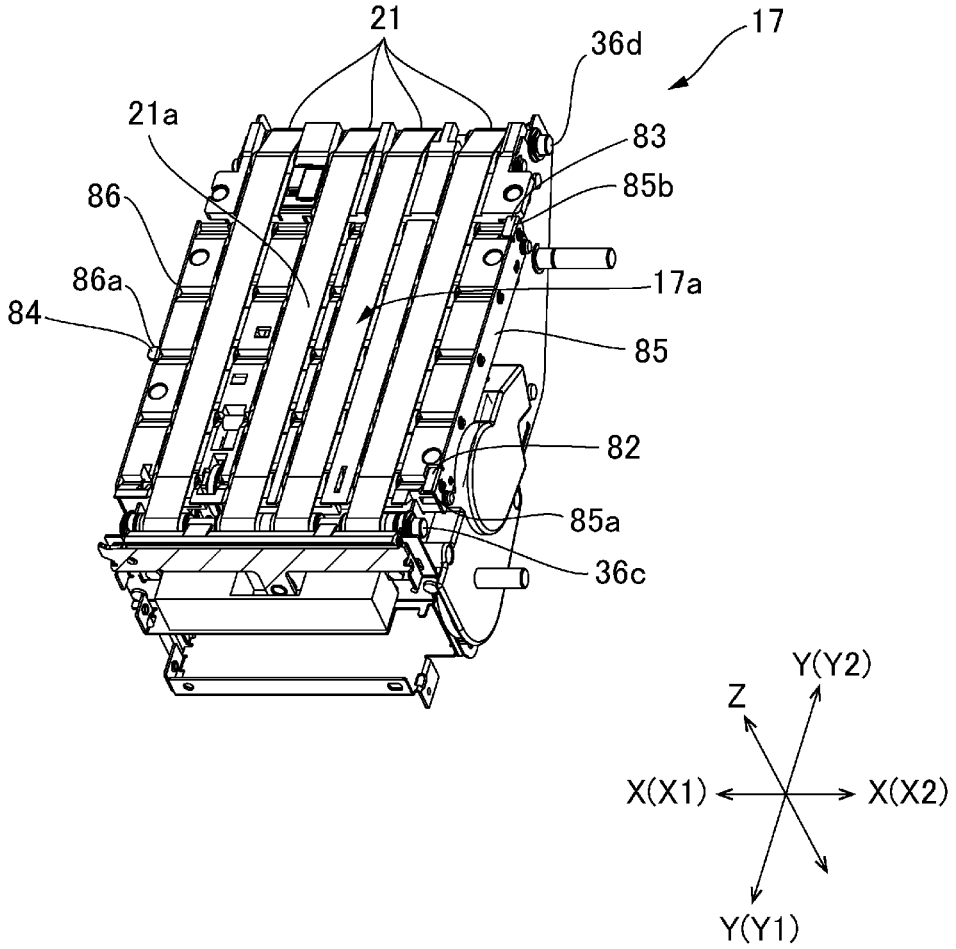
FIG. 10 is an oblique view of the platen unit.

FIG. 10 is an oblique view of the platen unit 17. The platen unit 17 includes the guide rollers 36*a* to 36*e*, the drive roller 36*f* that drives the conveyance belt 21, a unit housing 81 that supports the conveyance motor 38 (see FIG. 3), and four conveyance belts 21. The horizontal belt portions 21*a* of the four conveyance belts 21 are mounted in the unit housing 81 over the top surface of the platen unit opposite the head unit 12 such that they extend in the longitudinal axis.

The horizontal belt portion 21*a* is the part of each conveyance belt 21 disposed between the guide roller 36*c* disposed at the front end of the unit housing 81, and the guide roller 36*d* disposed at the back end part of the platen unit 17.

First to third platen-side stops 82 to 84 that can contact the ball bearings 23 to 25 of the gap forming unit 22 are disposed at three locations on the unit housing 81. The first platen-side stop 82 is disposed at the front part of the unit housing 81 at the end in the second direction X2. The second platen-side stop 83 is disposed at the back part of the unit housing 81 at the end in the second direction X2.

A metal first panel member 85 that is long in the longitudinal axis Y is disposed on the second direction X2 side of the unit housing 81. The first platen-side stop 82 and the second platen-side stop 83 are metal plate parts 85*a* and 85*b* that bend substantially in a direction perpendicular to the Z direction and extend horizontally to the inside where the horizontal belt portions 21*a* are located from the top edge of the front end and the top edge of the back end of the first panel member 85.

The third platen-side stop 84 is disposed on the unit housing 81 in the middle of the longitudinal axis Y at the end in the first direction X1. A metal second panel member 86 that extends in the direction of the longitudinal axis Y is disposed on the unit housing 81 on the first direction X1 side. The third platen-side stop 84 is a metal plate part 86*a* that bends substantially perpendicular to the z direction and extends horizontally to the outside from the opposite side as the side where the horizontal belt portions 21*a* are located at the middle of the second panel member 86 on the longitudinal axis Y.

When the carriage 11 is in the opposing position 11A, the first platen-side stop 82, second platen-side stop 83, and third platen-side stop 84 are respectively disposed at positions opposite the first carriage-side stop 47, second carriage-side stop 48, and third carriage-side stop 49, respectively.

The virtual plane defined by ends of the first platen-side stop 82, the second platen-side stop 83, and the third platen-side stop 84 is the same plane as the platen surface 17*a* defined by the horizontal belt portion 21*a*.

Gap Forming Unit

Figure 11:
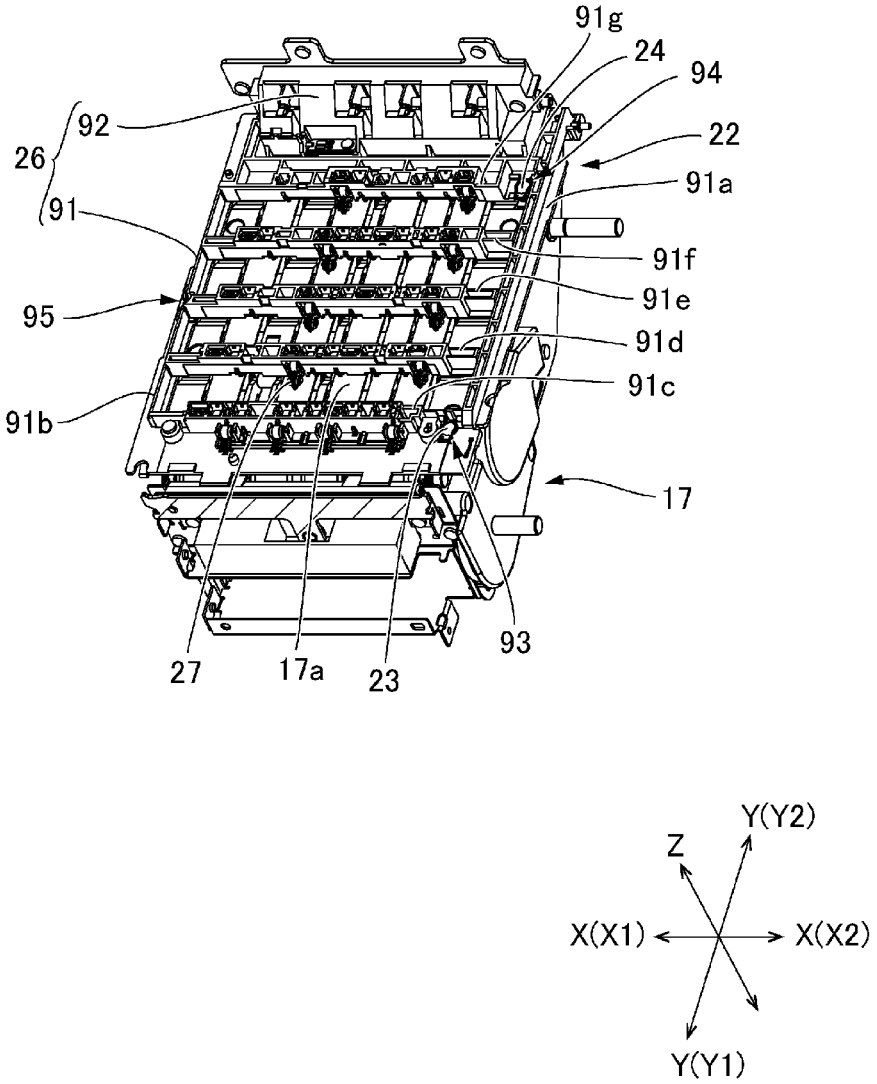
FIG. 11 is an oblique view of the gap forming unit and the platen unit.
Figure 12A:
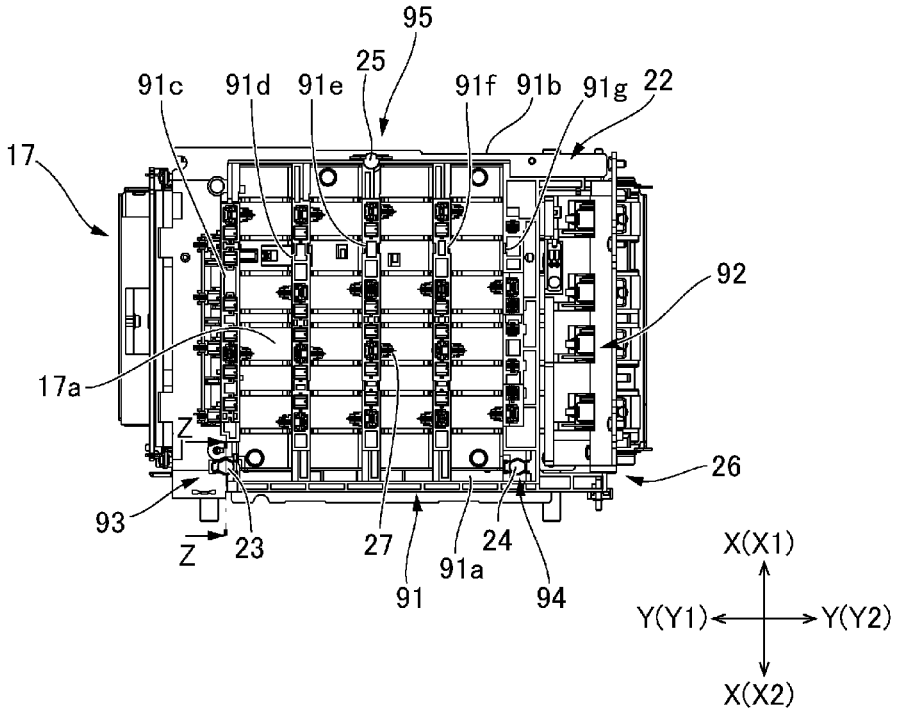
FIGS. 12A and 12B illustrate the gap forming unit.
Figure 12B:
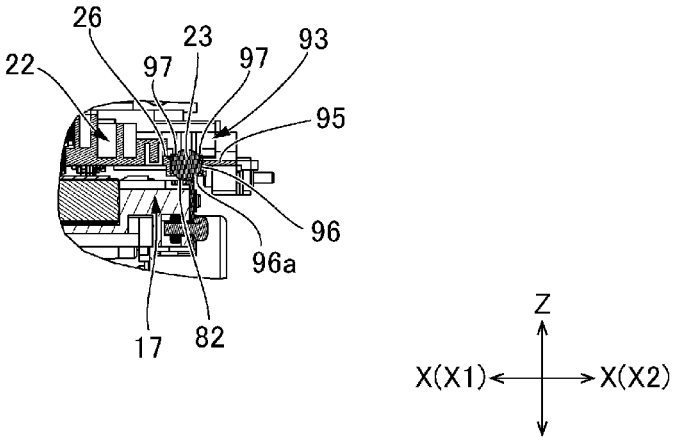

FIG. 11 is an oblique view of the gap forming unit 22 set above the platen unit 17. FIG. 12A is a plan view of the gap forming unit 22 set on the platen unit 17, and FIG. 12B is a section view through line Z-Z in FIG. 12A (a section view of the ball bearing holding unit).

The holding frame 26 is substantially rectangular and flat, and is disposed over the platen surface 17*a* of the platen unit 17. The holding frame 26 includes a thin holding frame body 91 disposed over the top of the platen unit 17, and a holding frame fastening unit 92 attached to the end of the holding frame body 91 on the Y2 side. The holding frame 26 is fastened to the main frame 20 (see FIG. 2) of the line printer 1 through the holding frame fastening unit 92.

The holding frame body 91 has a pair of longitudinal frame members 91*a*, 91*b* that extended parallel to the longitudinal axis Y along the left and right sides of the platen unit 17, and five horizontal frame members 91*c* to 91*g* formed at a regular interval in the direction extending along on the longitudinal axis Y. The horizontal frame members 91*c* to 91*g* extend parallel to the transverse axis X, and the ends thereof are connected to the longitudinal frame members 91*a*, 91*b*. As shown in FIG. 11, the ends of the longitudinal frame members 91*a*, 91*b* on the printer back Y2 side protrude further to the printer back Y2 side than the horizontal frame member 91*g* that is closest to the printer back Y2, and the holding frame fastening unit 92 is attached to these ends of the longitudinal frame members 91*a*, 91*b*.

Ball bearing holders 93 to 95 are formed at three locations on the holding frame body 91 where the three ball bearings 23 to 25 are held.

More specifically, the ball bearing holder 93 that holds the ball bearing 23 that contacts the first platen-side stop 82 is formed at the corner in the second direction X2 and the front end of the holding frame body 91 where the horizontal frame member 91*c* and the longitudinal frame member 91*a* connect.

The ball bearing holder 94 that holds the ball bearing 24 that contacts the second platen-side stop 83 is formed at the corner in the second direction X2 and the back end of the holding frame body 91 where the horizontal frame member 91*g* and the longitudinal frame member 91*a* connect.

The ball bearing holder 95 that holds the ball bearing 25 that contacts the third platen-side stop 84 is formed in the middle of the gap forming unit in the direction of the longitudinal axis Y where the horizontal frame member 91*e* connects to the longitudinal frame member 91*b*.

As shown in FIG. 12B, the ball bearing holder 93 includes a round through-hole 96 passing through the longitudinal frame member 91*a* of the holding frame 26 in the direction of the vertical axis; two linear support members 97 extending across the open edge of the opening on one side (the top) of the through-hole 96 in the direction of the vertical axis Z; and an annular stopper 96*a* that protrudes to the inside from the open edge of the other opening (the bottom) of the through-hole 96.

The inside diameter of the through-hole 96 is slightly greater than the diameter of the ball bearing 23, and the inside diameter of the opening on the inside circumference side of the stopper 96*a* is shorter than the diameter of the ball bearing 23. As a result, the stopper 96*a* can contact the ball bearing 23 from below.

The support members 97 are wires, and span the open edge of the other opening (top) of the through-hole 96 above the ball bearing 23. The support members 97 can therefore contact the ball bearing 23 from above. The middle part of the ball bearing 23 is therefore contained in the through-hole 96. The ball bearing 23 is also held by the ball bearing holder 93 so that the ball bearing 23 will not pop out on the vertical axis Z. The ball bearing holder 93 also holds the ball bearing 23 so that it can move slightly on the longitudinal axis Y and the transverse axis X inside the through-hole 96 and can roll.

The holding frame 26 also holds the ball bearing 23 in contact with the first platen-side stop 82.

Note that the structure of the other ball bearing holders 94 and 95 is the same. By thus supporting the three ball bearings 23 to 25 on the holding frame 26, each bearing can be disposed to a position that is not directly in line with the other two bearings. The three ball bearings 23 to 25 are the same size and same shape.

In addition to the ball bearings 23 to 25, the holding frame 26 also holds a star wheel 27. The star wheel 27 contacts the recording paper 6*a* conveyed over the platen surface 17*a* from above, and prevents the recording paper 6*a* from lifting away from the platen surface 17*a*. The star wheel 27 is disposed at a position not overlapping the inkjet line heads 41 to 44 of the printhead 8 when the carriage 11 is in the opposing position 11A and seen from the direction perpendicular to the platen surface 17*a*.

Setting the Printhead to the Print Position and Creating the Platen Gap

Figure 13A:
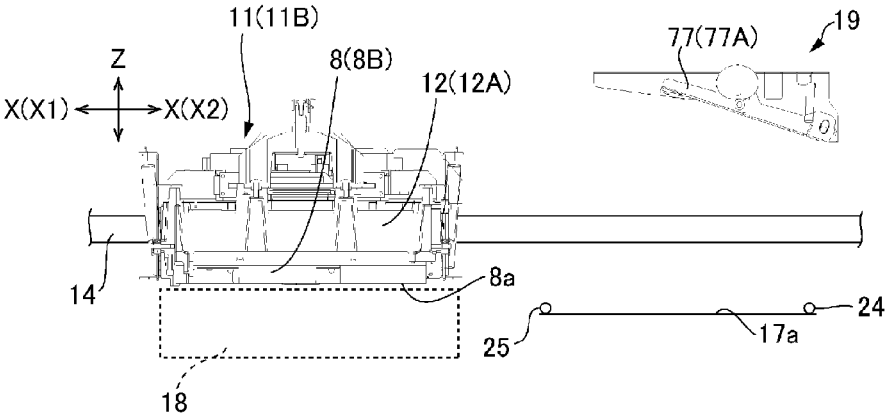
FIGS. 13A-13C illustrate the printhead and carriage moving operation.
Figure 13B:
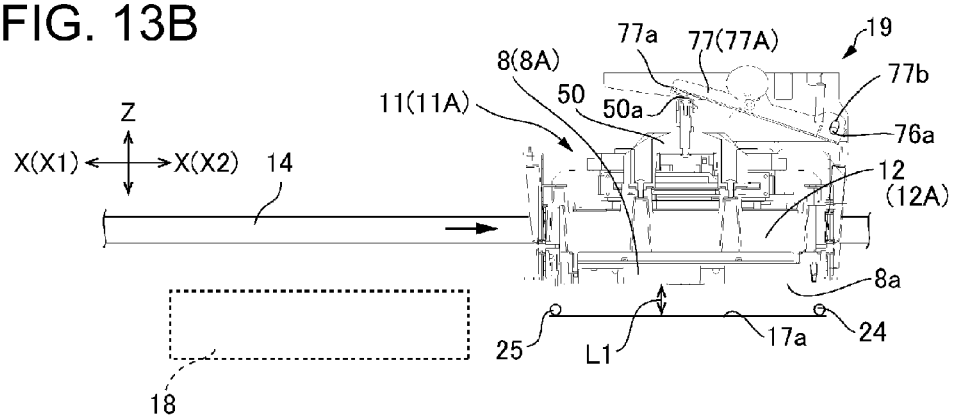
Figure 13C:
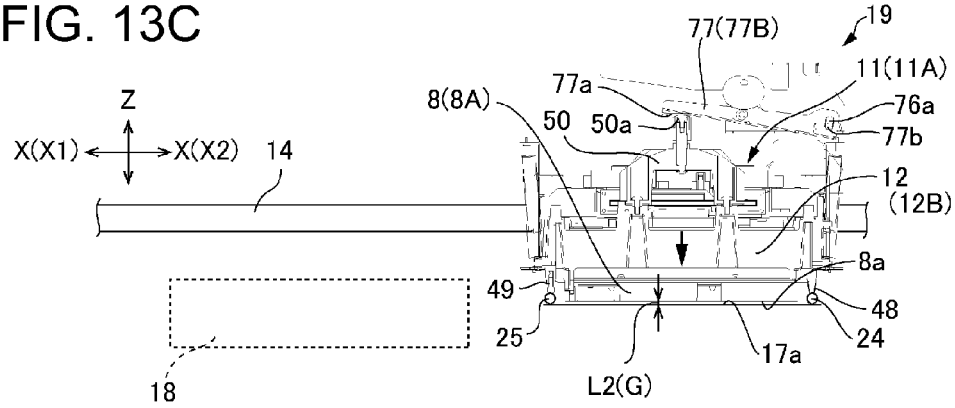
Figure 14A:
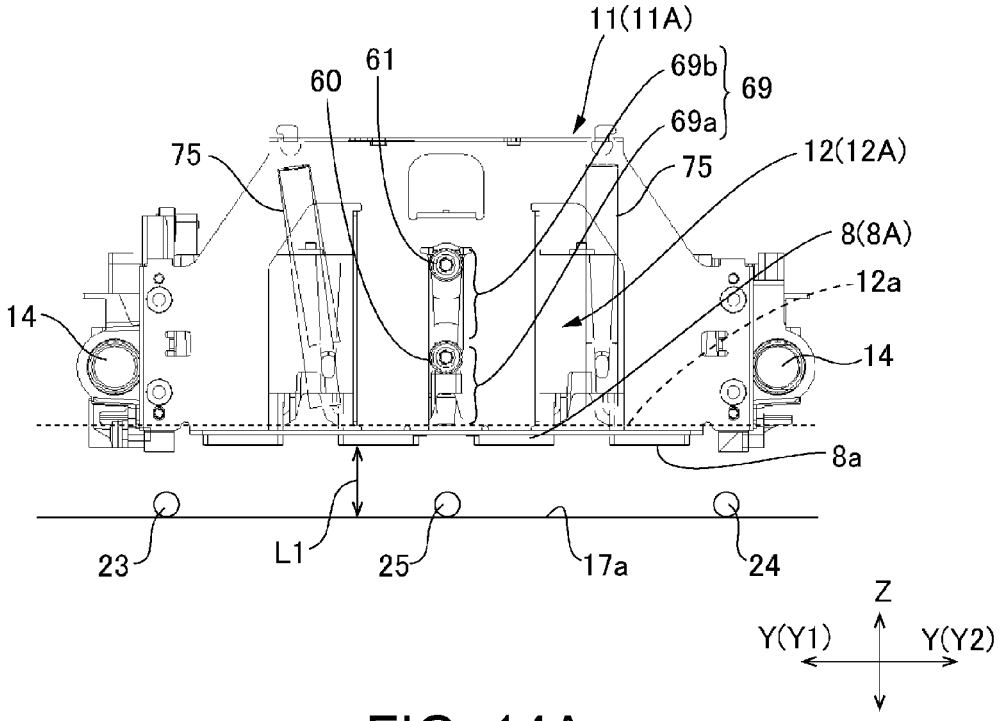
FIGS. 14A and 14B illustrate when the head unit is set to a first position.
Figure 14B:
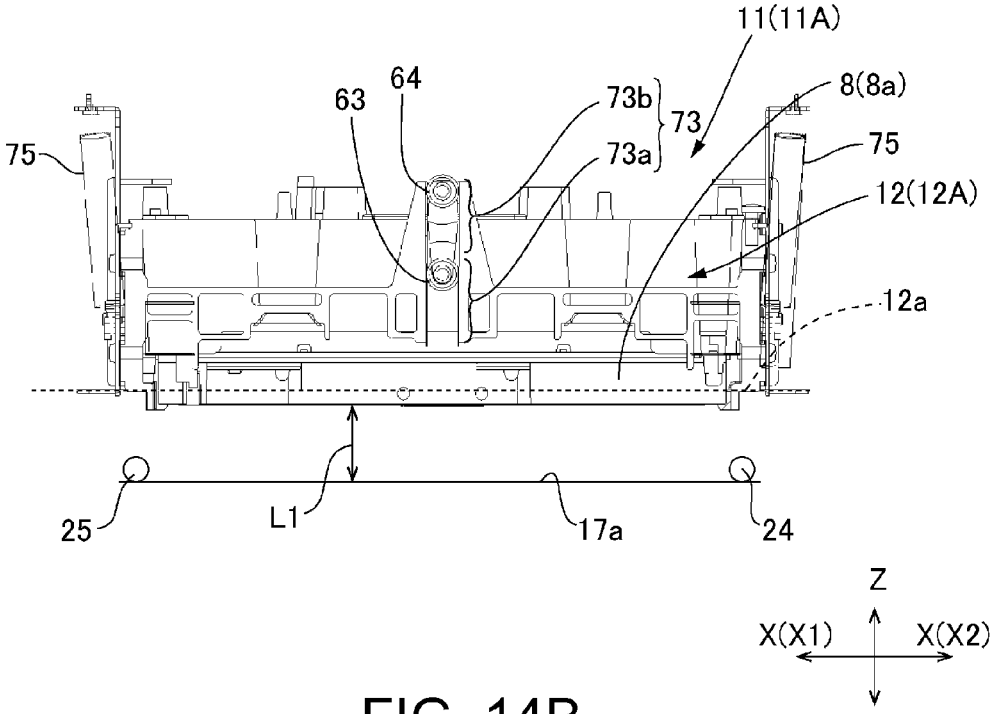

FIGS. 13A-13C illustrate the operation of setting the printhead 8 to the print position A. FIGS. 14A and 14B and FIGS. 15A and 15B illustrate the operation of setting the platen gap.

When the line printer 1 is in the standby position, the carriage 11 is in the standby position 11B as shown in FIG. 13A. Therefore, the printhead 8 is in the head standby position 8B and opposite the head maintenance unit 18. The head unit 12 holding the printhead 8 is urged by the coil springs 75 to the up position 12A. When the line printer 1 remains in the standby mode for an extended time, the head cap of the head maintenance unit 18 rises and caps the ink nozzle face 8*a* of the printhead 8.

When print data is supplied to the line printer 1, the carriage motor is driven. As a result, the carriage 11 moves along the carriage guide rails 14 in the second direction X2, and is set to the opposing position 11A shown in FIG. 13B. Because the head unit 12 is urged to the up position 12A at this position, the printhead 8 moves in the second direction X2 with the gap to the platen unit 17 held at a first distance L1, and is set to the opposing head position 8A opposite the platen unit 17.

The height of the gap forming unit 22 along the longitudinal axis Y is shorter than this first distance L1. Therefore, when the carriage 11 moves from the standby position 11B on the transverse axis X to the opposing position 11A, the printhead 8 does not collide with the gap forming unit 22.

When the carriage 11 is at the opposing position 11A, as shown in FIG. 13B, the operating unit 50 of the head unit 12 is located below the operating part 77*a* of the operating lever 77 of the head unit moving mechanism 19, which is in the lever-up position 77A. When the cam drive motor 19*a* is driven in this state, the operating lever 77 pivots down and is set to the lever-down position 77B. As a result, the head unit 12 moves in the direction toward the platen unit 17, and is set to the down position 12B as shown in FIG. 13C.

When the head unit 12 is set to the down position 12B, the ball bearings 23 to 25 of the gap forming unit 22 contact both the carriage-side stops 47 to 49 and the platen-side stops 82 to 84 as shown in FIG. 13C. If the force applied by the head unit moving mechanism 19 to the platen unit 17 of the head unit 12 is excessive in this event, the end of the operating lever 77 in the second direction X2 where the oval hole 77*b* is formed moves down relative to the support pin 76*a*, and relieves the excess force on the head unit 12. As a result, the urging force of the head unit moving mechanism 19 on the platen unit 17 is kept at an appropriate level.

As shown in FIGS. 14A and 14B and FIGS. 15A-15C, when the head unit 12 moves from the up position 12A to the down position 12B, the first bottom guide roller 60 moves through the first channel section 69*a* of the first guide channel 69 where the channel width is the same as the diameter of the first bottom guide roller 60. The second guide roller 62 also moves through the first channel section 70*a* of the second guide channel 70 where the channel width is the same as the diameter of the second guide roller 62, and the third bottom guide roller 63 moves through the first channel section 73*a* of the third guide channel 73 where the channel width is the same as the diameter of the third bottom guide roller 63.

Therefore, while moving from the up position 12A to the down position 12B, the head unit 12 does not move on the transverse axis X or the longitudinal axis Y on the carriage frame 13.

Figure 15A:
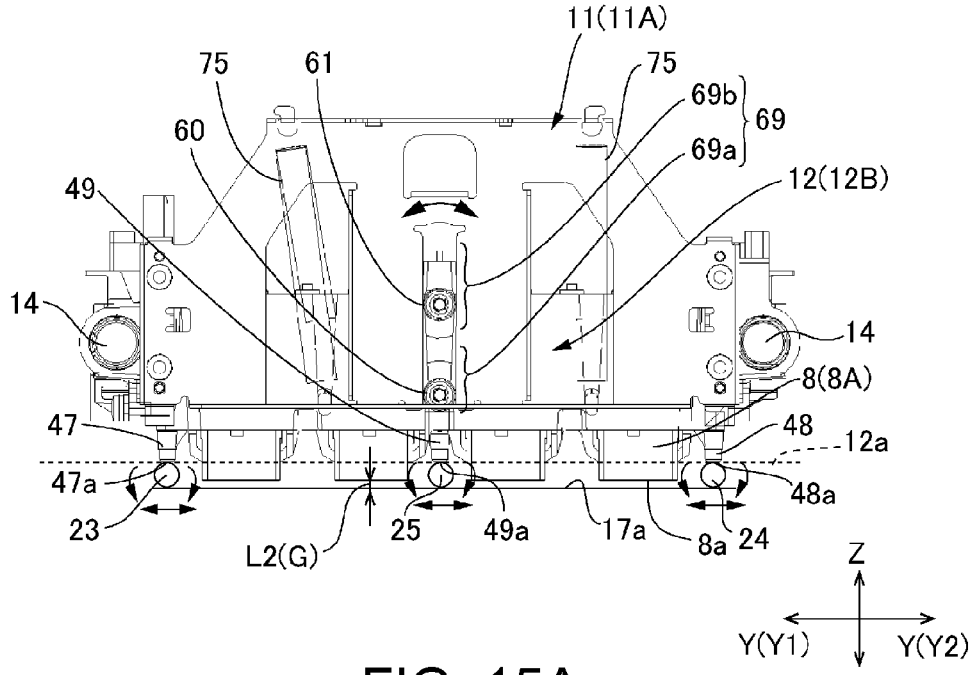
FIGS. 15A and 15B illustrate when the head unit is set to a second position.

When the head unit 12 moves from the up position 12A to the down position 12B, the first top guide roller 61 moves through the second channel section 69*b* of the first guide channel 69 where the channel width is greater than the diameter of the first top guide roller 61. Therefore, as shown in FIG. 15A, the first top guide roller 61 can move along the Y axis in the first guide channel 69, and the head unit 12 can tilt on the carriage frame 13 on the longitudinal axis Y centered on the axis of rotation of the first bottom guide roller 60.

Figure 15B:
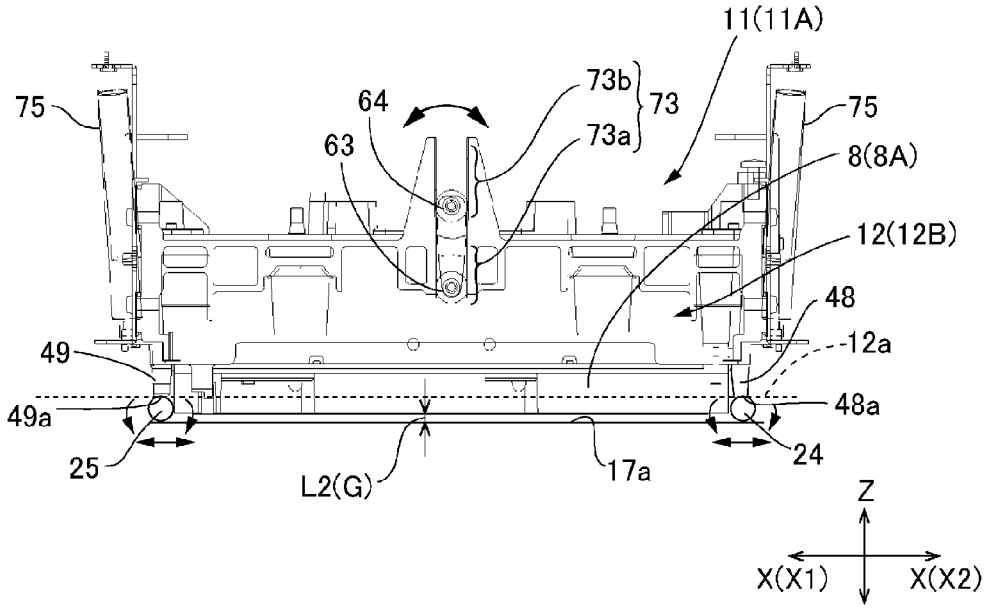

When the head unit 12 moves from the up position 12A to the down position 12B, the third top guide roller 64 also moves through the second channel section 73*b* of the third guide channel 73 where the channel width is greater than the diameter of the third top guide roller 64. Therefore, as shown in FIG. 15B, the third top guide roller 64 can move on the transverse axis X in the second channel section 73*b*, and the head unit 12 can tilt on the carriage frame 13 on the transverse axis X centered on the axis of rotation of the third bottom guide roller 63.

Therefore if the reference surface 12*a* of the head unit 12 and the platen surface 17*a* are not parallel when the ball bearings 23 to 25 of the gap forming unit 22 contact both the carriage-side stops 47 to 49 and the platen-side stops 82 to 84, the posture of the head unit 12 is corrected by contact between the head unit 12 and the three ball bearings 23 to 25, and the reference surface 12*a* of the head unit 12 and the platen surface 17*a* become parallel.

As a result, the gap between the reference surface 12*a* of the head unit 12 and the platen unit 17 becomes a distance equal to the diameter of the ball bearings 23 to 25, and the platen gap G between the printhead 8 and the platen unit 17 is a constant second distance L2 that is shorter than the diameter of the ball bearings 23 to 25.

When the platen gap G is the second distance L2, the printhead 8 can print. The line printer 1 can therefore execute the conveyance operation that conveys the recording paper 6*a* at a constant speed by means of the paper conveyance mechanism. 35 and the printing operation that drives the printhead 8 to print in parallel, and can print on the surface of the recording paper 6*a* passing the print position A.

When the printing of the print data ends, the printhead 8 returns to the head standby position 8B. More specifically, when the printing of the print data ends, the cam drive motor 19*a* is driven, and the operating lever 77 is returned to the lever-up position 77A. As a result, the head unit 12 rises due to the urging force of the coil springs 75 and is set to the up position 12A as shown in FIG. 13B.

When the carriage motor is later driven in reverse, the carriage 11 returns from the opposing position 11A to the standby position 11B as shown in FIG. 13A. As a result, the printhead 8 is set to the head standby position 8B opposite the head maintenance unit 18.

Effect of Operation

This embodiment of the invention moves the carriage 11 from the standby position 11B to the opposing position 11A when the head unit 12 is set to the up position 12A. This embodiment also lowers the head unit 12 from the up position 12A to the down position 12B at the standby position 11B. Therefore, the gap between the printhead 8 and the platen unit 17 can be set to a wide first distance L1 when the printhead 8 moves from the head standby position 8B to the opposing head position 8A opposite the platen unit 17. As a result, when a gap forming unit 22 and star wheel 27 or other media separation prevention member are disposed above the platen unit 17, contact between these and the printhead 8 can be prevented. Furthermore, when the printhead 8 moves to the position opposite the platen unit 17, the gap between the printhead 8 and the platen unit 17 can be shortened. This cap can therefore be set to a distance appropriate to printing.

In this embodiment of the invention, the coil springs 75 urges the head unit 12 to the up position 12A, and the head unit moving mechanism 19 moves the head unit 12 from the up position 12A to the down position 12B in resistance to the urging force of the coil springs 75. Therefore, when the head unit 12 is at the up position 12A, the carriage 11 can be easily moved from the standby position 11B to the opposing position 11A. In other words, when the printhead 8 moves from the head standby position 8B to the opposing head position 8A opposite the platen unit 17, the gap between the printhead 8 and the platen unit 17 can be easily held at a wide first distance L1. Furthermore, because the urging force of the coil springs 75 is applied to the head unit 12 at the down position 12B, the head unit 12 that was set to the down position 12B can be easily returned to the up position 12A.

The ball bearings 23 to 25 in this embodiment of the invention are also supported by a holding frame 26 so that they can roll, and are supported movably on the transverse axis X and the longitudinal axis Y by the holding frame 26. Therefore, when the head unit 12 and platen unit 17 are in contact with the ball bearings 23 to 25, the posture of the head unit 12 changes and the reference surface 12*a* of the head unit 12 and the platen surface 17*a* are made parallel, the ball bearings 23 to 25 can be easily moved relative to the head unit 12, and the ball bearings 23 to 25 can be easily moved relative to the platen unit 17. As a result, friction between the ball bearings 23 to 25 and the head unit 12 and friction between the ball bearings 23 to 25 and the platen unit 17 is reduced, and wear on the head unit 12 and the platen unit 17 when the platen gap G is set can be easily prevented or suppressed.

Furthermore, when the head unit 12 is set to the down position 12B in this embodiment of the invention, the head unit moving mechanism 19 pushes the head unit 12 in the direction toward the platen unit 17. The posture of the head unit 12 can therefore be changed by the pressure from the head unit moving mechanism 19, and the reference surface

12*a* of the head unit 12 and the platen surface 17*a* can be set parallel to each other. Furthermore, the pressure from the head unit moving mechanism 19 can maintain a desirable platen gap G.

Variation

The ball bearings 23 to 25 are disposed between the head unit 12 and platen unit 17, and the platen gap G is created by setting these ball bearings 23 to 25 in contact with the head unit 12 and platen unit 17 in this embodiment of the invention. However, gap-forming protrusions that set a constant gap between the printhead 8 and the platen unit 17 may be disposed instead of ball bearings to at least one of the head unit 12 and the platen unit 17 to contact the other of the head unit 12 and the platen unit 17 when the head unit 12 is set to the down position 12B. In this configuration, the gap-forming protrusions are preferably disposed at the locations of the three ball bearings 23 to 25 described above.

In the embodiment described above, the posture of the head unit 12 changes when the head unit 12 and the platen unit 17 contact the ball bearings 23 to 25, but the posture on the platen unit 17 side may be changed to make the reference surface 12*a* of the head unit 12 and the platen surface 17*a* parallel. In this case, a configuration having a platen unit frame that supports the platen unit 17 so that its posture can change, fastens the platen unit frame to the main frame 20 or other member.

The ball bearings 23 to 25 are metal ball bearings with high dimensional precision in the embodiment described above, so that the platen gap G can be easily controlled to a specific dimension.

Furthermore, because the platen-side stops 82 to 84 of the platen unit 17 that contact the ball bearings 23 to 25 are also metal parts 85*a*, 85*b*, and 86*a*, wear of the platen unit 17 can be reliably prevented.

When the recording paper 6*a* jams between the gap forming unit 22 and platen unit 17 at the print position A in this embodiment of the invention, the platen unit 17 is moved from the reference position 17A to the retracted position 17B and the jammed recording paper 6*a* can be removed. The ball bearings 23 to 25 held by the gap forming unit 22 are in contact with the platen unit 17 at the reference position 17A in this event, but are supported by the holding frame 26 so that they can roll and can move in the direction of the transverse axis X and the longitudinal axis Y. Friction between the ball bearings 23 to 25 and the platen unit 17, or friction between the ball bearings 23 to 25 and the jammed recording paper 6*a*, can therefore be reduced when the platen unit 17 is moved from the reference position 17A to the retracted position 17B. The platen unit 17 can therefore be easily moved to the retracted position 17B, and the jammed recording paper 6*a* can be easily removed.

The embodiment described above disposes three ball bearings (bearing balls) between the head unit 12 and the platen unit 17 in order to form the desired platen gap G, but four or more ball bearings may be used instead. In this event, the holding frame 26 is configured to hold each ball so that it can roll and can move on the transverse axis X and the longitudinal axis Y.

The foregoing embodiment describes changing the posture of the head unit 12, but when the head unit 12 and platen unit 17 contact the ball bearings 23 to 25, the posture of the platen unit 17 side could be changed to make the reference surface 12*a* of the head unit 12 and the platen surface 17*a* parallel. In this configuration, the platen support mechanism 16, for example, supports the platen unit 17 so that the posture of the platen unit 17 can change. In addition, a configuration that causes the posture to change on the platen unit 17 side by urging the platen unit 17 through the ball bearings 23 to 25 to the head unit 12 side when the ball bearings 23 to 25, the head unit 12, and the platen unit 17 contact, is also conceivable.

The invention being thus described, it will be apparent that it may be varied in many ways. Such variations are not to be regarded as a departure from the spirit and scope of the invention, and all such modifications as would be apparent to one skilled in the art are intended to be included within the scope of the following claims.

What is claimed is:

1. A line printer comprising:

a printhead;

a platen;

a carriage including a head unit configured to support the printhead and a frame configured to movably support the head unit;

a carriage moving mechanism configured to move the carriage between an opposing position where the printhead is opposite the platen, and a standby position where the printhead is not opposite the platen;

a head unit moving mechanism configured to move the head unit in a direction toward the platen when the carriage is set to the opposing position; and a bearing ball that is disposed between the head unit and the platen, and is configured to contact the head unit and the platen, and sets a constant gap between the head unit and the platen.

2. The line printer described in claim 1, wherein:

the frame is configured to support the head unit movably between a first position where the gap between the printhead and the platen is a first distance, and a second position where said gap is a second distance that is shorter than the first distance; and the head unit moving mechanism is configured to move the head unit set to the first position to the second position.

3. The line printer described in claim 1, wherein:

the head unit moving mechanism is configured to move the carriage in a direction of opposition perpendicular to the direction.

4. The line printer described in claim 2, wherein:

the carriage has an urging member that produces an urging force that urges the head unit to the first position; and the head unit moving mechanism moves the head unit in resistance to the urging force of the urging member from the first position to the second position.

5. The line printer described in claim 2, wherein:

the second position is a position where the printhead can print to recording paper on the platen.

6. The line printer described in claim 5, further comprising:

wherein the bearing ball is configured to set a specific gap between the printhead and the platen, and contact both the carriage and the platen when the head unit is at the second position.

7. The line printer described in claim 5, further comprising:

a gap-forming protrusion that is disposed to at least one of the head unit and the platen, and when the head unit is at the second position, contacts the other and sets a specific gap between the printhead and the platen.

8. The line printer described in claim 6, wherein:

the carriage comprises a guide mechanism that guides movement of the head unit; and the guide mechanism comprises a guide channel disposed on one of the head unit and the frame, and a guide roller that is disposed on the other of the head unit and the frame and is inserted in the guide channel.

9. The line printer described in claim 8, wherein:

the guide channel extends in the direction extending between the printhead and the platen, and comprises a first channel section having a first channel width that is the same as the diameter of the guide roller, and a second channel section having a second channel width that is greater than the first channel width;

a first guide roller and a second guide roller are disposed as guide rollers; and when the head unit moves between the first position and the second position, the first guide roller moves through the first channel section, and the second guide roller is configured to move through the second channel section.

10. A line printer comprising:

a platen opposite a printhead;

a head unit that holds the printhead; and a bearing ball that is disposed between the head unit and the platen, and is configured to contact the head unit and the platen, and sets a constant gap between the head unit and the platen.

11. The line printer described in claim 10, further comprising:

a holding frame configured to hold the bearing ball so that the bearing ball can roll.

12. The line printer described in claim 11, wherein:

the holding frame is configured to hold the bearing ball movably in a direction of opposition perpendicular to a direction extending between the printhead and the platen.

13. The line printer described in claim 11, wherein:

there are at least three bearing balls disposed to mutually separated positions; and the holding frame is configured to hold each of the bearing balls at a position not on a line joining the other two bearing balls.

14. The line printer described in claim 11, wherein:

the holding frame has a ball holding unit configured to hold the bearing ball; and the ball holding unit has a through-hole that extends in the direction extending between the printhead and the platen to which the bearing ball is partially inserted, and a support member that spans the opening on one side of the through-hole in the direction of opposition at the edge of the opening, and can contact the bearing ball from the one side.

15. The line printer described in claim 11, further comprising:

a moving mechanism that moves the head unit between a first position where the gap is a first distance, and a second position where the gap is a second distance that is shorter than the first distance;

wherein the holding frame is configured to hold the bearing ball in contact with the platen; and the head unit contacts the bearing ball when set to the second position.

16. The line printer described in claim 10, further comprising:

an urging member configured to urge either the head unit or the platen to the other through the bearing ball.

17. The line printer described in claim 11, further comprising:

a platen support mechanism configured to support the platen movably between a reference position opposite the printhead, and a retracted position that is different from the reference position;

the holding frame is set to a position causing the bearing ball to contact the platen when the platen is at the reference position, and separates the bearing ball from the platen when the platen is at the retracted position.

18. A printhead moving method of a line printer, comprising:

setting a printhead at a printhead standby position not opposite a platen to a head-opposing position opposite the platen;

moving the printhead in a direction toward the platen at the head-opposing position; and setting a constant gap between the head unit and the platen with a bearing ball that is disposed between the head unit and the platen, wherein the bearing ball contacts the head unit and the platen when the constant gap is set.

19. The printhead moving method of a line printer described in claim 18, further comprising:

moving the printhead while holding the gap between the platen and the printhead at a first distance; and moving the printhead between the printhead and the platen to a second distance that is shorter than the first distance.

20. The printhead moving method of a line printer described in claim 18, further comprising:

moving the printhead in a direction perpendicular to the direction.

* * * * *